US009873016B2

(12) United States Patent
Ellis

(10) Patent No.: US 9,873,016 B2
(45) Date of Patent: Jan. 23, 2018

(54) UPPER AND LOWER BODY MULTI-PRESS EXERCISE MACHINE

(71) Applicant: Joseph K. Ellis, Ocala, FL (US)

(72) Inventor: Joseph K. Ellis, Ocala, FL (US)

(73) Assignee: Ellis I.P., Inc., Ocala, FL (US)

( * ) Notice: Subject to any disclaimer, the term of this patent is extended or adjusted under 35 U.S.C. 154(b) by 0 days.

(21) Appl. No.: 14/840,776

(22) Filed: Aug. 31, 2015

(65) Prior Publication Data

US 2015/0367173 A1 Dec. 24, 2015

Related U.S. Application Data

(63) Continuation-in-part of application No. 14/564,974, filed on Dec. 9, 2014, which is a continuation-in-part (Continued)

(51) Int. Cl.

| | |
|---|---|
| ***A63B 21/068*** | (2006.01) |
| ***A63B 21/08*** | (2006.01) |
| ***A63B 21/00*** | (2006.01) |
| ***A63B 23/035*** | (2006.01) |
| ***A63B 22/20*** | (2006.01) |
| ***A63B 21/045*** | (2006.01) |

(Continued)

(52) U.S. Cl.

CPC .. *A63B 23/03516* (2013.01); *A63B 21/00069* (2013.01); *A63B 21/00181* (2013.01); *A63B 21/045* (2013.01); *A63B 21/068* (2013.01); *A63B 21/0615* (2013.01); *A63B 21/159* (2013.01); *A63B 21/4033* (2015.10); *A63B 21/4047* (2015.10); *A63B 21/4049* (2015.10); *A63B 22/205* (2013.01); *A63B 23/0205* (2013.01); *A63B 23/0222* (2013.01); *A63B 23/0227* (2013.01); *A63B 23/03525* (2013.01); *A63B 21/008* (2013.01); *A63B 21/0085* (2013.01); *A63B 21/012* (2013.01);

(Continued)

(58) Field of Classification Search

CPC . A63B 22/0012; A63B 22/0015; A63B 22/20; A63B 22/201; A63B 22/203; A63B 22/205; A63B 23/00; A63B 23/02; A63B 23/0205; A63B 23/0222; A63B 23/0227; A63B 23/0233; A63B 23/035; A63B 23/03575; A63B 21/0076; A63B 21/0087; A63B 21/0089

See application file for complete search history.

(56) References Cited

U.S. PATENT DOCUMENTS 5,370,594 A * 12/1994 Grinblat ..... A63B 21/4047 482/72

5,518,483 A * 5/1996 Oswald ..... A63B 21/012 482/114

(Continued)

*Primary Examiner* — Nyca T Nguyen

(74) *Attorney, Agent, or Firm* — Laurence P. Colton; Smith Tempel Blaha LLC

(57) ABSTRACT

A machine for concurrently performing pressing motions with the hands and feet, the machine having a base having front and back ends, two or more user supports, at least one lower body user support with an engagement means for the user's feet and at least one upper body user support with an engagement means for the user's hands. The upper body user support and lower body user support move forwards and backwards along the frame and at least one of the upper body user supports and at least one of the lower body user supports cooperate with one another to move in opposing forwards and backwards movement patterns during operation of the machine.

16 Claims, 33 Drawing Sheets

Related U.S. Application Data of application No. 14/207,020, filed on Mar. 12, 2014, now abandoned, which is a continuation-in-part of application No. 14/148,303, filed on Jan. 6, 2014, which is a continuation-in-part of application No. 13/967,188, filed on Aug. 14, 2013, now Pat. No. 8,888,661, which is a continuation-in-part of application No. 13/992,744, filed as application No. PCT/US2011/065738 on Dec. 19, 2011, now Pat. No. 9,539,460.

(51) Int. Cl.

| | |
|---|---|
| ***A63B 21/06*** | (2006.01) |
| ***A63B 23/02*** | (2006.01) |
| *A63B 21/008* | (2006.01) |
| *A63B 21/012* | (2006.01) |
| *A63B 21/02* | (2006.01) |
| *A63B 22/14* | (2006.01) |
| *A63B 21/062* | (2006.01) |

(52) U.S. Cl.

CPC ..... *A63B 21/02* (2013.01); *A63B 21/0628* (2015.10); *A63B 21/4035* (2015.10); *A63B 22/14* (2013.01); *A63B 2208/0219* (2013.01); *A63B 2225/09* (2013.01)

(56) References Cited

U.S. PATENT DOCUMENTS

| | | | | | |
|---|---|---|---|---|---|
| 5,554,086 | A | 9/1996 | Habing | | |
| 5,569,132 | A * | 10/1996 | Wu | A63B 21/068 | 482/72 |
| 5,580,340 | A * | 12/1996 | Yu | A63B 21/055 | 482/72 |
| 6,264,588 | B1 | 7/2001 | Ellis | | |
| 6,287,241 | B1 | 9/2001 | Ellis | | |
| 7,104,933 | B1 * | 9/2006 | Liao | A63B 21/012 | 482/114 |
| 7,220,221 | B2 | 5/2007 | Moismann | | |
| 7,232,404 | B2 | 6/2007 | Nelson | | |
| 7,335,140 | B2 | 2/2008 | Webber | | |
| 7,455,633 | B2 | 11/2008 | Brown | | |
| 7,585,263 | B2 | 9/2009 | Brown | | |
| 7,594,880 | B2 | 9/2009 | Webber | | |
| 7,611,446 | B2 | 11/2009 | Chuang | | |
| 7,662,076 | B1 | 2/2010 | Ho | | |
| 7,727,128 | B2 | 6/2010 | Giannelli | | |
| 7,731,638 | B2 | 6/2010 | Webber | | |
| 7,780,585 | B1 * | 8/2010 | Rivas | A63B 21/0552 | 482/140 |
| 7,833,143 | B1 * | 11/2010 | Tsai | A63B 21/0552 | 482/140 |
| 7,867,149 | B1 | 1/2011 | Webber | | |
| 7,963,890 | B2 | 6/2011 | Webber | | |
| 8,162,807 | B1 | 4/2012 | Webber | | |
| 8,172,732 | B1 | 5/2012 | Webber | | |
| 8,317,665 | B2 | 11/2012 | Webber | | |
| 8,888,661 | B2 | 11/2014 | Ellis | | |
| 2002/0013199 | A1 * | 1/2002 | Giannelli | A63B 21/068 | 482/95 |
| 2010/0048367 | A1 * | 2/2010 | Liang | A63B 21/154 | 482/130 |
| 2010/0311555 | A1 * | 12/2010 | Campanaro | A63B 21/068 | 482/142 |
| 2011/0028283 | A1 | 2/2011 | Webber | | |

* cited by examiner

UPPER AND LOWER BODY MULTI-PRESS EXERCISE MACHINE

STATEMENT OF RELATED APPLICATIONS

This patent application claims the benefit of pending U.S. patent application Ser. No. 14/564,974 having a filing date of 9 Dec. 2014, which claims the benefit of pending U.S. patent application Ser. No. 14/207,020 having a filing date of 12 Mar. 2014, which claims the benefit of pending U.S. patent application Ser. No. 14/148,303 having a filing date of 6 Jan. 2014, which claims the benefit of U.S. patent application Ser. No. 13/967,188 having a filing date of 14 Aug. 2013, now U.S. Pat. No. 8,888,661 having an issue date of 18 Nov. 2014, which claims the benefit of pending U.S. patent application Ser. No. 13/992,744 having a filing date of 9 Jun. 2013, which claims the benefit of expired International Application No. PCT/US2011/065738 having an international filing date of 19 Dec. 2011.

BACKGROUND OF THE INVENTION

Technical Field

This invention relates to the general technical field of exercise, physical fitness and physical therapy equipment and machines. This invention relates more specifically to the field of exercise equipment for concurrently exercising the user's upper and lower body with multiple pressing motions.

Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on specific areas or muscle groups of the body such as the legs, the hips and lower torso, the chest and upper torso, the back, the shoulders and the arms. The operations of these machines generally concentrate on a single muscle group such as biceps, pectorals, quadriceps and so forth. Other equipment and machines are designed to aid the user in the exercise regimen, such as to aid the elderly, handicapped, and/or infirm in an appropriate exercise regimen. There are numerous examples each of these different types of exercise equipment and machines.

Generally, such equipment and machines can be categorized into three broad categories: free weights, mechanically operated single action resistance machines, and electrically operated resistance machines. Mechanically operated single action resistance machines can be subcategorized into three broad categories: stack weight resistance operated, free weight resistance operated, and alternative resistance operated. Mechanically operated single action resistance machines are available for exercising, strengthening and rehabilitating various individual muscles, muscle groups, combinations of muscle groups, joints, and other parts of the body.

This inventor previously has developed a composite motion movement machine for use in connection with exercise and physical therapy equipment. U.S. Pat. No. 6,264,588 discloses this composite motion movement machine, which combines a moving actuating member and a moving user support, the composite motion movement machine having a support member, a frame on which the user support is located, the frame being pivotably connected to the support member, a truck in slidable engagement with the support member and the frame, an actuating member being pivotably connected to the support member and operatively connected to the truck, the actuating member being adapted to move between a first position and a second position, and a linking mechanism operatively connecting said actuating member with said truck, wherein, when the user moves the actuating member between the first position and the second position, the truck moves along rails on the support member, forcing the frame to pivot relative to the support member and causing the user to actuate a resistance weight, thus exercising, strengthening or rehabilitating certain of the user's muscles. This machine can be used in connection with a variety of different resistance or assistance mechanisms, such as stack weights, free weights, and alternative weight resistance devices.

U.S. Pat. No. 8,888,661 discloses this inventor's improvement on abdominal and core exercise apparatuses by utilizing a centrally pivoting linkage member that is operatively attached on a first end to a pivoting upper body actuating member and operatively attached on an opposite second end to a sliding while pivoting user support. When the user pulls the upper body actuating member towards the user support, this causes the first end of the centrally pivoting linkage member to move downward and causes the opposite second end of the centrally pivoting linkage member to move upward, thus causing the sliding while pivoting user support to move in a direction towards the pivoting upper body actuating member with the user support pivoting upwardly from back to front. This causes the user's upper and lower extremities to be in an extended position in the first position of the exercise and in a contracted position in the second position of the exercise, thus causing certain muscles of the user's abdominals and core portion of the torso to be exercised. This machine can be used in connection with a variety of different resistance or assistance mechanisms, such as stack weights, free weights, and alternative weight resistance devices.

U.S. Pat. No. 6,287,241 discloses this inventor's improvement on leg press exercise apparatuses by utilizing composite motion movement combined with a moving actuating member and a moving user support, the leg press having a support member, a frame on which the user support is located, the frame being pivotably connected to the support member, a truck in slidable engagement with the support member and the frame, an actuating member on which a push plate is located, the actuating member being pivotably connected to the support member and operatively connected to the truck, the actuating member being adapted to move between a first position and a second position, and a linking mechanism operatively connecting the actuating member the truck, wherein, when the user pushes the actuating member between the first position and the second position, the truck moves along rails on the support member, forcing the frame to pivot relative to the support member and causing the user to actuate a resistance weight, thus exercising certain of the user's muscles. This machine can be used in connection with a variety of different resistance or assistance mechanism, such as stack weights, free weights, and alternative weight resistance devices.

U.S. Pat. Nos. 7,232,404, 7,455,633, 7,585,263, and 7,611,446 disclose abdominal exercise machines and/or methods. U.S. Pat. No. 7,651,446 discloses an elliptical core cycle exercise apparatus. U.S. Pat. Nos. 7,662,076, 8,172,732, 8,317,665, 8,162,807, 7,963,890, 7,731,638, and 7,594,880 disclose exercise machines. U.S. Pat. No. 7,867,149 discloses a swiveling user support assembly. U.S. Pat. No. 7,335,140 discloses a triceps dip exercise machine. US Patent Publication No. 2011/0028283 discloses an exercise machine. U.S. Pat. Nos. 5,554,086, 7,220,221, and 7,727,128 disclose various types of leg press machines.

Current exercise machines generally only allow the user to move in one plane of motion and concentrate the exercise on one set of muscles. However, many people would prefer to exercise concurrently in multiple planes of motion. Such a machine would provide a more safe and effective workout. Moreover, exercising an upper body set of muscles via a pressing motion concurrently with a lower body set of muscles via a pressing motion through multiple planes of motion would be even more desirable and beneficial. Thus it can be seen that an exercise machine that allows the exercising in at least two planes of pressing motions concurrently and optionally exercising two or more muscle groups concurrently would be useful, novel and not obvious, and a significant improvement over the prior art. It is to such a machine that the current invention is directed.

BRIEF SUMMARY OF THE INVENTION

The present invention provides a safer and more efficient method of a pressing exercise that imitates natural human motion by jointly leveraging the user's upper and lower body to concurrently press against one or more resistance mechanism or mechanisms. While the user's upper body and lower body press in generally opposite directions for this invention, they can move in the same or different planes of motion. The invention can be presented in various embodiments with the common feature of all the embodiments being that at least a portion of the user's upper and lower body exercise simultaneously by pressing handles and or platforms away from one another in a diverging pattern which may follow a combination of curved, arcing, or liner paths away from one another to move the user's body from a first position where at least one of the user's upper and at least one of the user's lower extremities are in a more contracted position to a second position where at least one of the user's upper and one of the user's lower extremities are in a more extended position. In some embodiments, it is beneficial to the user for the upper body pushing member to comprise two separate hand grips to be located a greater distant from one another in the first more contracted extremities position and converge to a lesser distance location in the second more extended extremities position.

In yet other embodiments it is beneficial to have two separate hand grips and two separate foot platforms such that a first hand grip can cooperate with a first foot platform and a second hand grip can cooperate with a second foot platform. It is also beneficial in this embodiment for the first and second foot platforms to contain a latching mechanism such that the first and second foot platforms can be left unlatched to operated independently or latched together to operate in unison as one unit. In certain embodiments it also is beneficial for the resistance to the user during the pressing motions to continually increase while the user is continuing to extend at least one of their upper and lower extremities and for the resistance to cease increasing when the user ceases pressing and extending at least one of their upper and lower extremities, and for the resistance to decrease while the user decreases their pressing force with at least one of their upper and lower extremities and is returning to a more contracted position.

Concurrent upper and lower body exercises are very beneficial forms of exercising to increase strength and flexibility of the major muscle groups as well as the connecting tendons and ligaments of the joints, such as knees, hips, ankles, neck, elbows, and shoulders. Most everyday human physical activities involve movement of multiple joints concurrently with engagement of multiple muscle groups causing a person to go through multiple planes of motion. Therefore, exercise regimens having multiple planes of motion will better condition the body to perform the way it naturally moves. Moreover, combining upper and lower body motions into one exercise offers even more benefits as the user is able to leverage their entire body against a resistance force like they would naturally.

Prior to this inventor's inventions of concurrent training multi-dimensional exercise machines, physical fitness and rehabilitation regimens have consisted of free form movements of uncontrolled objects such as barbells, dumbbells, tires, and sleds. These are means of exercising that require advanced skill and knowledge to be performed correctly and safely. This type of exercising also generally requires well above average physical capabilities. The present invention supports and locates the user's body throughout the entire range of multi-dimensional motion of the exercise movement, which allows people of ordinary skill, knowledge, and physical capabilities to perform more effective exercises safely.

All of the preferred embodiments of the invention allow the user to add additional resistance to the exercise. This includes utilizing free weights that can be directly loaded onto the user supports, user engagement means, linkage mechanisms, rotational axles, or lever arms that are operatively connected the user supports, user engagement means, linkage mechanisms, or rotational axles. This also includes utilizing multiple resistance means that can be operatively connected to the user supports, user engagement means, linkage mechanisms, or rotation axles, such as weight stacks, hydraulics, pneumatics, springs, elastic bands, magnetic devices, electronic devices, alternators, generators, friction brakes, moment arms, and the like.

The invention can comprise one or more slide rails. Said slide rails may be linear or may be curved in one or more radii and may curve in one or more directions. Two or more of said slide rails may be equal parallel distances apart or may be configured in a converging or diverging pattern. The slide rails support at least one slidable or rolling members. The slidable members are of sufficient size and strength to support a human user as well as any additional weight or resistance that may be added to the exercise regimen.

The invention also can comprise at least one lower body user support that can be attached to a first slidable member or members or can pivot on a multi-bar linkage. The at least one lower body user support is a support pad for the user's lower legs sufficient in size to support at least a portion of the user's lower extremities. The at least one lower body user support or supports also comprises a pressing bar or platform for the user's feet to press against during the exercise regimen. The invention further can comprise at least one upper body user support. Said at least one upper body user support can be attached to a second slidable member or members or can be an elongated member or members rigidly attached to a rotatable axle. The at least one upper body user support contains at least one pressing handle for the user to grip and press during the exercise regimen. The at least one lower body user support and the at least one upper body user support are operatively connected such that at least one of the user's upper and at least one of the user's lower extremities may work in unison during the exercise regimen.

In certain embodiments there is a single lower body user support and a single upper body user support. In this embodiment the upper and lower body user supports are operatively connected such that both of the user's arms and both of the user's legs work dependently and in unison against a common resistance.

In another embodiment the lower body user support is two separate members, one for each of the user's legs, that can operate independently of one another, and the upper body user support is two separate members that also can operate independently of one another. In this embodiment a first of the separate lower body user support members is operatively connected to a first of the separate upper body user support members, and the second of the separate lower body user support members is operatively connected to the second of the separate upper body user support members such that the user can press and move a user's first upper and lower body extremities independently of a user's second upper and lower body extremities. In this embodiment there also may be a latching lever, component, or mechanism that can be latched or unlatched such that the two independent lower body user supports can be latched together to move as one unit or unlatched to work independently of one another.

In another embodiment of the invention there are two separate lower body user support members and two separate upper body user support members, each of which operate independently of each other but are operatively connected to a common resistance mechanism such that any of the four of the user support members can be operated independently to work against the resistance mechanism while the other user support members stay in the at rest position. Alternatively, any combination of two, three, or four of the independent user support members can be operated simultaneously to work against the common resistance mechanism.

In another embodiment the lower body user support is two separate slidable members, one for each of the user's legs, that can be unlatched to operate independently of each other or latched together to operate in unison. The upper body user supports are two separate pivotable members that are each operatively connected to one of the lower body user supports such that the left side upper and lower body user supports can operate in unison and the right side upper and lower body user supports can operate in unison or both lower body user supports and both upper body user supports can all operate in unison.

In another embodiment the lower body user support is one rigid slidable member and the upper body user support is one rigid pivotable member. In this embodiment the upper and lower body user supports are operatively connected such that both of the user's arms and both of the user's legs work dependently and in unison against a common resistance.

In another embodiment the lower body user support or supports are mounted on a multi-bar link system such as a parallelogram and the upper body user support or supports are rigid pivoting members, and the lower body user support or supports and the upper body user support or supports are operatively connected such that at least one of the user's arms and at least one of the user's legs can work dependently and in unison.

In certain other embodiments the resistance is continually increased while the user supports are moving from the at rest position towards the fully activated position and the resistance is continually decreased while the user supports are moving from the extended and fully activated position towards the at rest position and anytime the user supports are engaged and stopped anywhere between the at rest position and the fully activated positions the resistance remains constant.

In certain embodiments there are two separate upper body user supports that can operate in a parallel movement pattern. In other embodiments there are two separate upper body user supports that can operate in a converging and reciprocating diverging path movement pattern.

In still other embodiments the user can adjust the at rest starting position of either the upper body user support member or members or the lower body user support member or members or all user support pushing members so as to accommodate users of various sizes and physical capabilities or to effect the desired function.

These features, and other features and advantages of the present invention, will become more apparent to those of ordinary skill in the art when the following detailed description of the preferred embodiments is read in conjunction with the appended figures in which like reference numerals designate like elements throughout the several views.

BRIEF DESCRIPTION OF THE DRAWINGS

The figures most often show the embodiments of the invention from one side. For the most part, the invention looks the same, but in a mirror image, from the opposite side, with both sides having similar structures, features, and components.

DETAILED DESCRIPTION OF PREFERRED EMBODIMENTS

Exemplary preferred embodiments are disclosed below in connection with the attached drawings. Throughout this specification, various terms will be used to describe various elements or sets of elements, features or sets of features, and devices or sets of devices. For example the term rearward end or portion of the machine 200 would refer to the end or portion of the machine most near the user's feet and distal to the user's hands. The term forward end or portion of the machine 200 would refer to the end or portion of the machine most near the user's hands and distal to the user's feet. The term user support or slidable user support will be used to describe any bar, handle, pad, platform, or other elements that the user engages during operation of the machine. The terms at rest, unactivated, and starting positions will be used to describe when the user is not engaging the device, or only minimally so. The terms activated, extended, and operating will be used to describe when the user is engaging the device. The term releasing or releases will be used to describe the user's action during operation of the machine when they are reducing or lessening their exertion force upon the user engagement means. The terms push, pushing, press, or pressing when referring to the user operating the machine will be used to describe any motion or movement by a user when they are maintaining or increasing their exertion force. The term upper body will refer generally to the user's arms and hands but may also refer to the user's chest, back, and torso as well. The term lower body will generally refer to the user's legs and feet but may also refer to the user's buttocks and hips as well.

FIGS. 1-33 are all views of embodiments of the invention this inventor terms a total body press or multi-press machine. Generally, the invention is a machine for concurrently exercising two or more of a user's muscle groups, the machine having a frame consisting of, two or more user supports, and engagement members for the user's lower and upper body. The user supports are operatively connected in various configurations and in some embodiments the activation by the user of a first of the at least one of the user support engagement means will engage and act upon at least a second of user support engagement means. All of the embodiments of the invention allow the user to add resistance to the exercise motion created by activating the machine.

Figure 1:
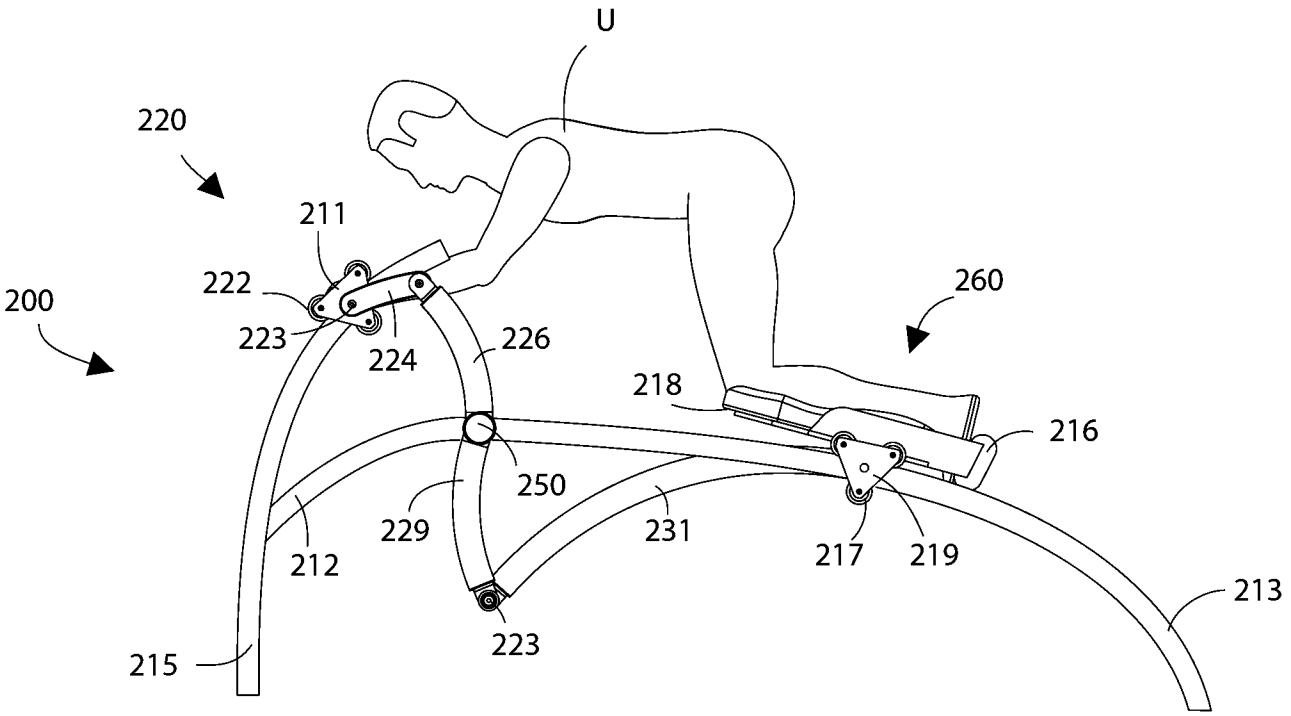
FIG. 1 is a side view of a first embodiment of the invention in the at rest and unactivated position showing a user mounted on the machine that is a combination of a lower body user support slidably connected to a set of curved rails and an upper body user support slidably connected to a set of curved rails wherein the upper body user support and the lower body user support are operatively connected via a multi-link linkage system that is rotatable around a rotatable central axle.
Figure 2:
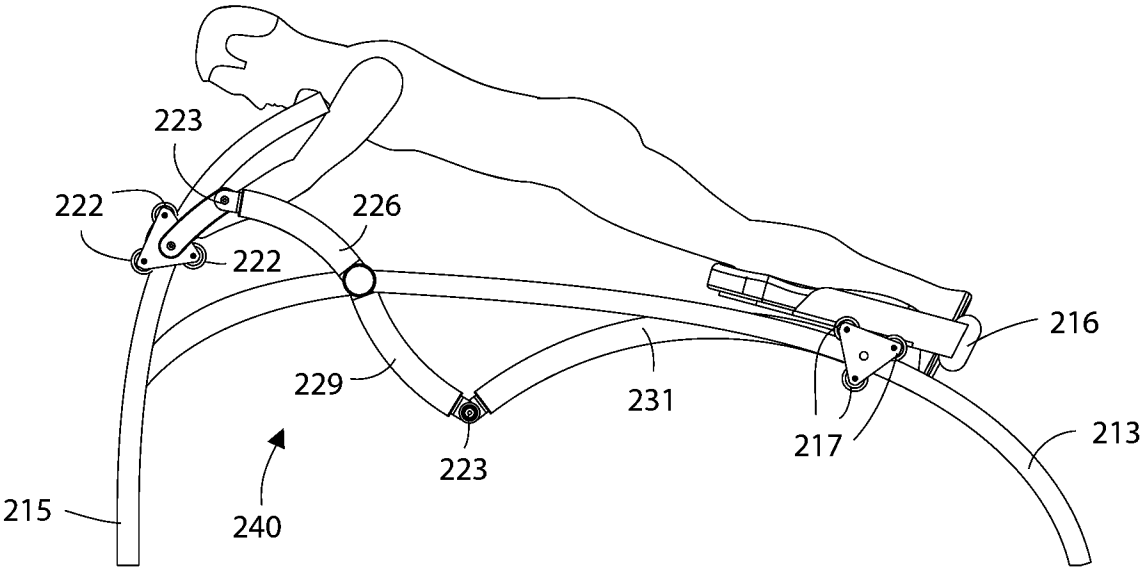
FIG. 2 is a side view of a first embodiment of the invention in the extended and activated position showing a user mounted on the machine that is a combination of a lower body user support slidably connected to a set of curved rails and a upper body user support slidably connected to a set of curved rails wherein the upper body user support and the lower body user support are operatively connected via a multi-link linkage system that is rotatable around a rotatable central axle.
Figure 3:
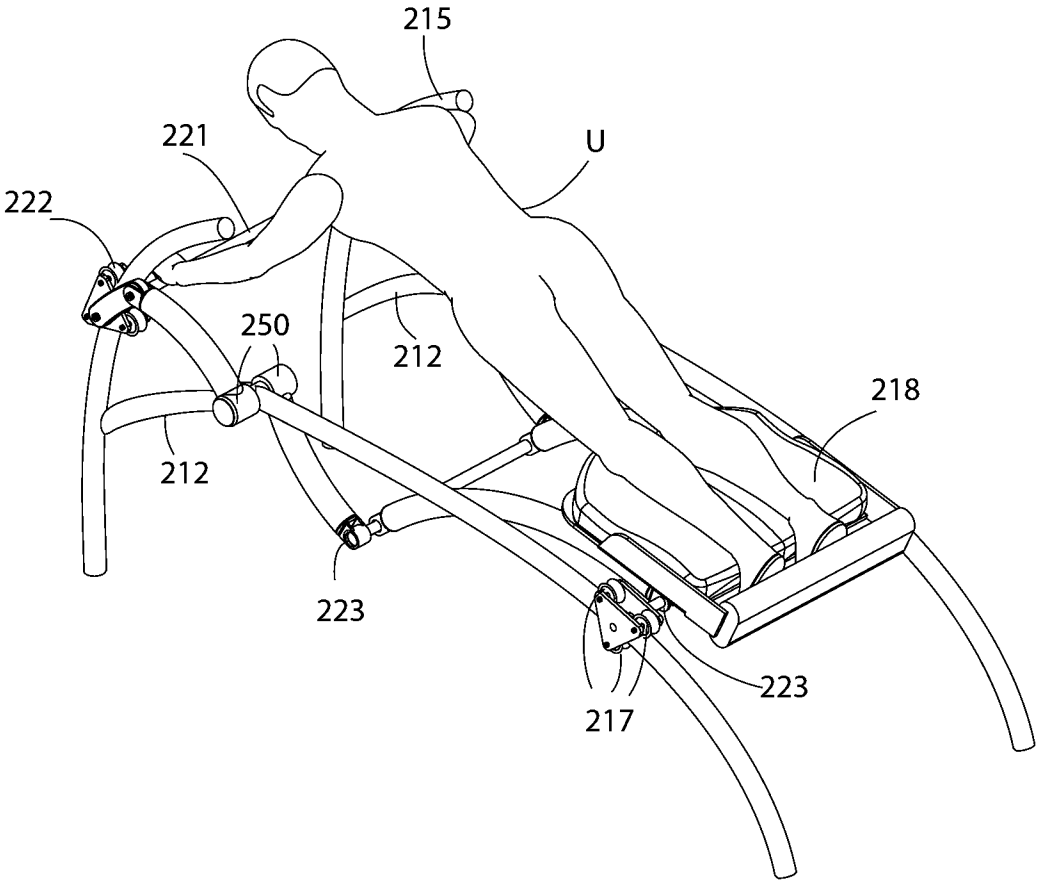
FIG. 3 is a perspective view of a first embodiment of the invention in the extended and activated position showing a user mounted on the machine that is a combination of a lower body user support slidably connected to a set of curved rails and an upper body user support slidably connected to a set of curved rails wherein the upper body user support and the lower body user support are operatively connected via a multi-link linkage system that is rotatable around a rotatable central axle.
Figure 4:
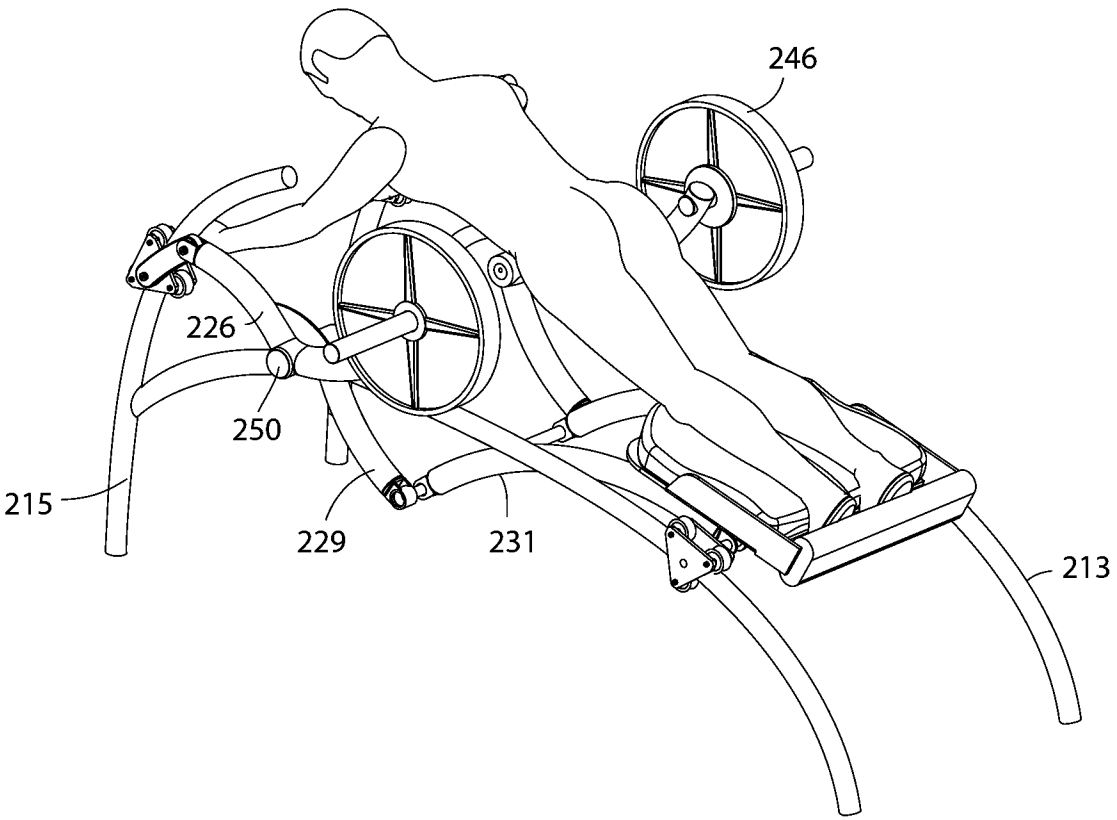
FIG. 4 is a perspective view of a first embodiment of the invention in the extended and activated position showing a user mounted on the machine that is a combination of a lower body user support slidably connected to a set of curved rails and an upper body user support slidably connected to a set of curved rails wherein the upper body user support and the lower body user support are operatively connected via a multi-link linkage system that is rotatable around a rotatable central axle and a resistance arm is rigidly attached to the rotatable central axle.

FIG. 1 is a side view of a first embodiment with a user mounted on the machine in the at rest position illustrating the slidable upper and lower body user supports each mounted on curved rails and operatively connected via a multi-link linkage system that is rotatable around a rotatable central axle. FIG. 2 is a side view of this first embodiment in the activated position illustrating the slidable upper and lower body user supports each mounted on curved rails and operatively connected via a multi-link linkage system that is rotatable around a rotatable central axle in the at rest position. FIG. 3 is a perspective view of this first embodiment with a user mounted on the machine in the activated position illustrating the slidable upper and lower body user supports each mounted on curved rails and operatively connected via a multi-link linkage system that is rotatable around a rotatable central axle. FIG. 4 is a perspective view of this first embodiment with the machine in the activated position illustrating the slidable upper and lower body user supports each mounted on curved rails and operatively connected via a multi-link linkage system that is rotatable around a rotatable central axle with resistance arms rigidly attached to the rotatable central axles.

Figure 5:
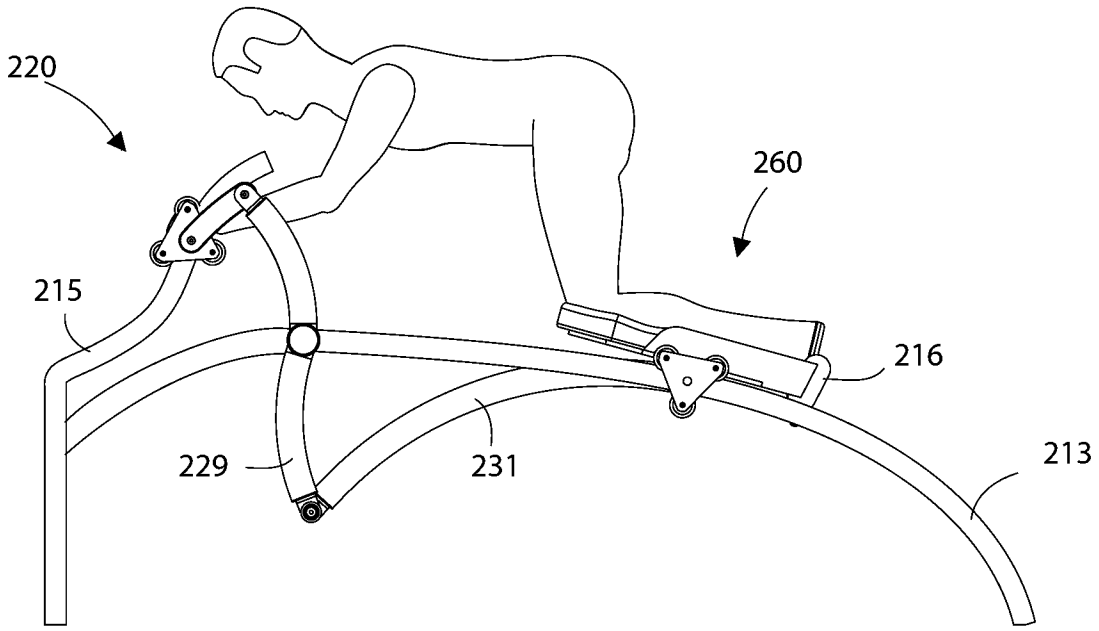
FIG. 5 is a side view of an alternate embodiment of the invention in the at rest and unactivated position showing a user mounted on the machine that is a combination of a lower body user support slidably connected to a set of curved rails and a upper body user support slidably connected to a set of multi directional curved rails wherein the upper body user support and the lower body user support are operatively connected via a multi-link linkage system that is rotatable around a rotatable central axle.
Figure 6:
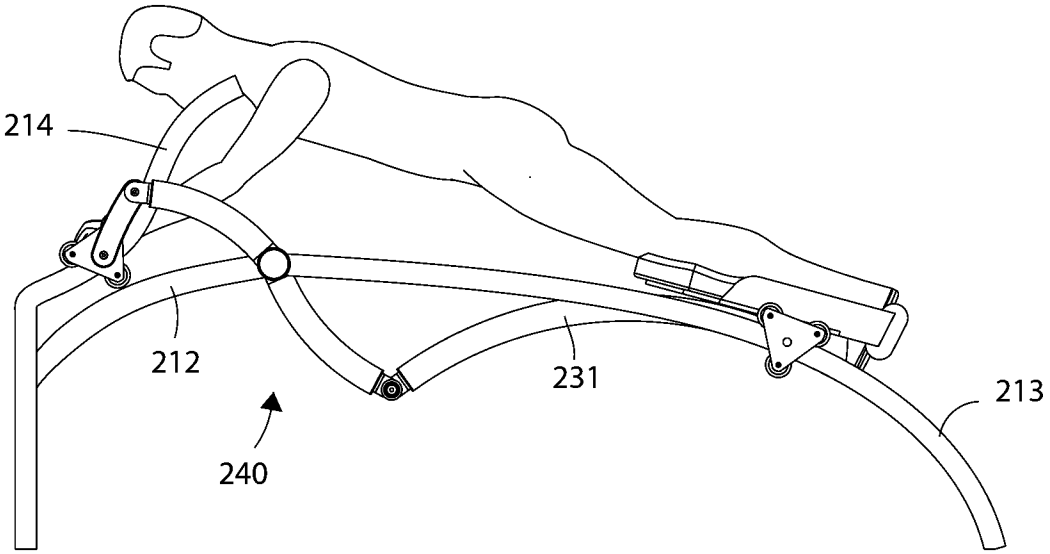
FIG. 6 is a side view of an alternate embodiment of the invention in the extended and activated position showing a user mounted on the machine that is a combination of a lower body user support slidably connected to a set of curved rails and an upper body user support slidably connected to a set of multi directional curved rails wherein the upper body user support and the lower body user support are operatively connected via a multi-link linkage system that is rotatable around a rotatable central axle.
Figure 7:
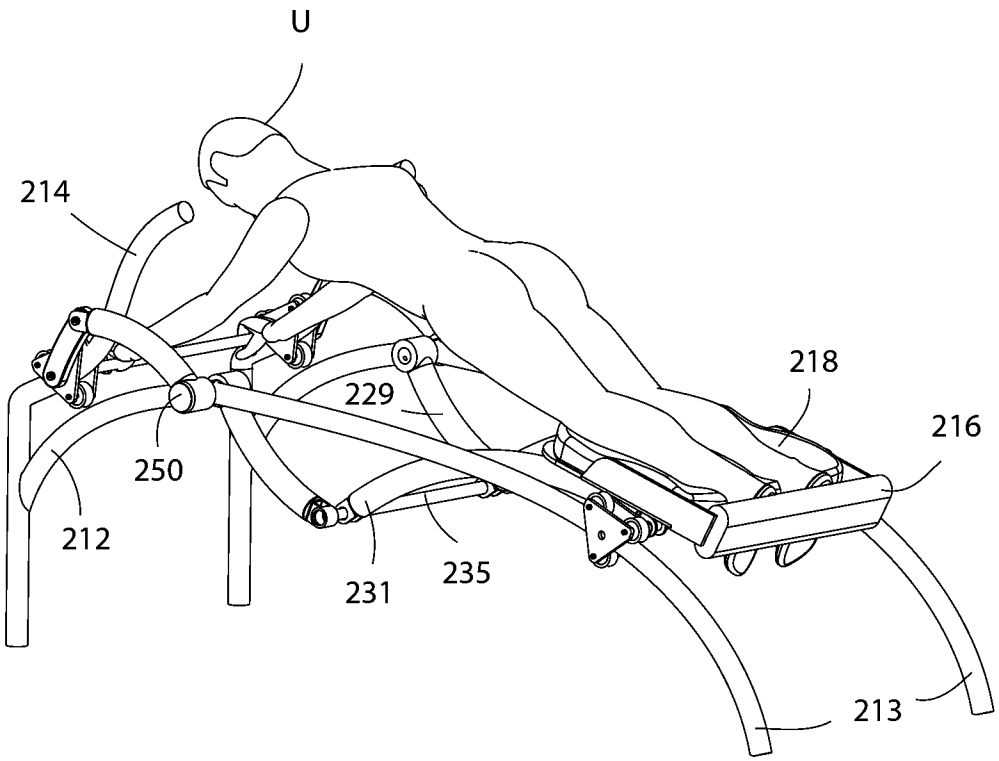
FIG. 7 is a perspective view of an alternate embodiment of the invention in the extended and activated position showing a user mounted on the machine that is a combination of a lower body user support slidably connected to a set of curved rails and an upper body user support slidably connected to a set of multi-directional curved rails wherein the upper body user support and the lower body user support are operatively connected via a multi-link linkage system that is rotatable around a rotatable central axle.
Figure 8:
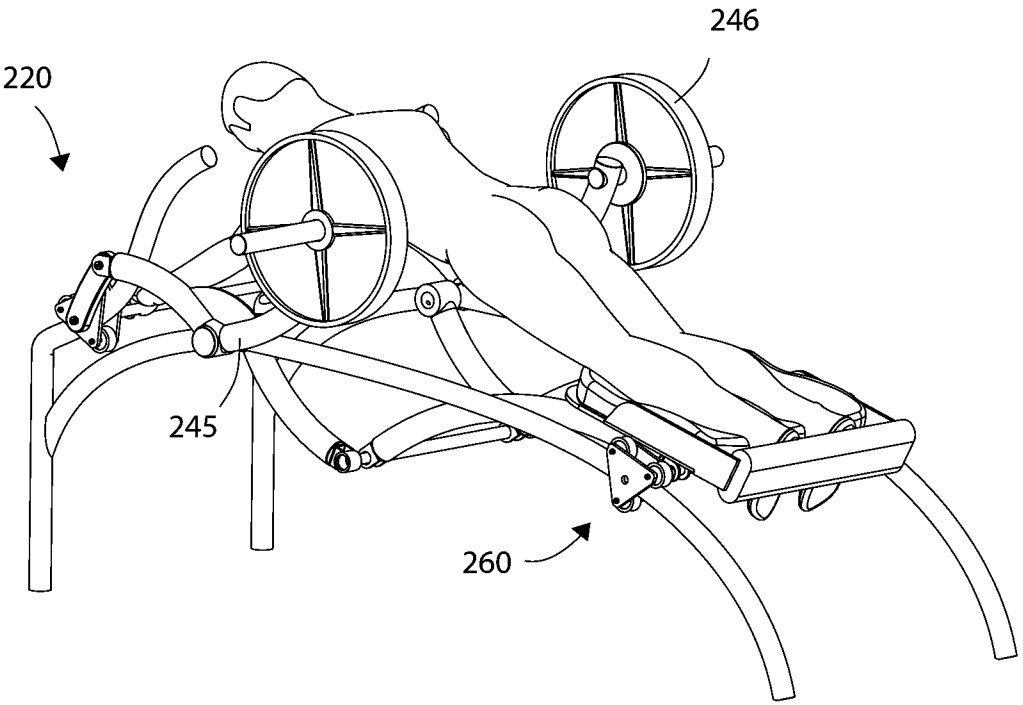
FIG. 8 is a perspective view of an alternate embodiment of the invention in the extended and activated position showing a user mounted on the machine that is a combination of a lower body user support slidably connected to a set of curved rails and an upper body user support slidably connected to a set of multi-directional curved rails wherein the upper body user support and the lower body user support are operatively connected via a multi-link linkage system that is rotatable around a rotatable central axle and a resistance arm is rigidly attached to the rotatable central axle.

FIG. 5 is a side view of an alternate, second embodiment with a user mounted on the machine in the at rest position illustrating the slidable upper body user support mounted on a multi-directional curved rail and lower body user support mounted on a curved rail wherein the user supports are operatively connected via a multi-link linkage system that is rotatable around a rotatable central axle. FIG. 6 is a side view of an alternate, second embodiment with a user mounted on the machine in the extended and activated position illustrating the slidable upper body user support mounted on a multi-directional curved rail and lower body user support mounted on a curved rail wherein the user supports are operatively connected via a multi-link linkage system that is rotatable around a rotatable central axle. FIG. 7 is a perspective view of an alternate, second embodiment with a user mounted on the machine in the extended and activated position illustrating the slidable upper body user support mounted on a multi-directional curved rail and lower body user support mounted on a curved rail wherein the user supports are operatively connected via a multi-link linkage system that is rotatable around a rotatable central axle. FIG. 8 is a perspective view of an alternate, second embodiment with a user mounted on the machine in the extended and activated position illustrating the slidable upper body user support mounted on a multi-directional curved rail and lower body user support mounted on a curved rail wherein the user supports are operatively connected via a multi-link linkage system that is rotatable around a rotatable central axle with resistance arms rigidly attached to the rotatable central axles.

Figure 9:
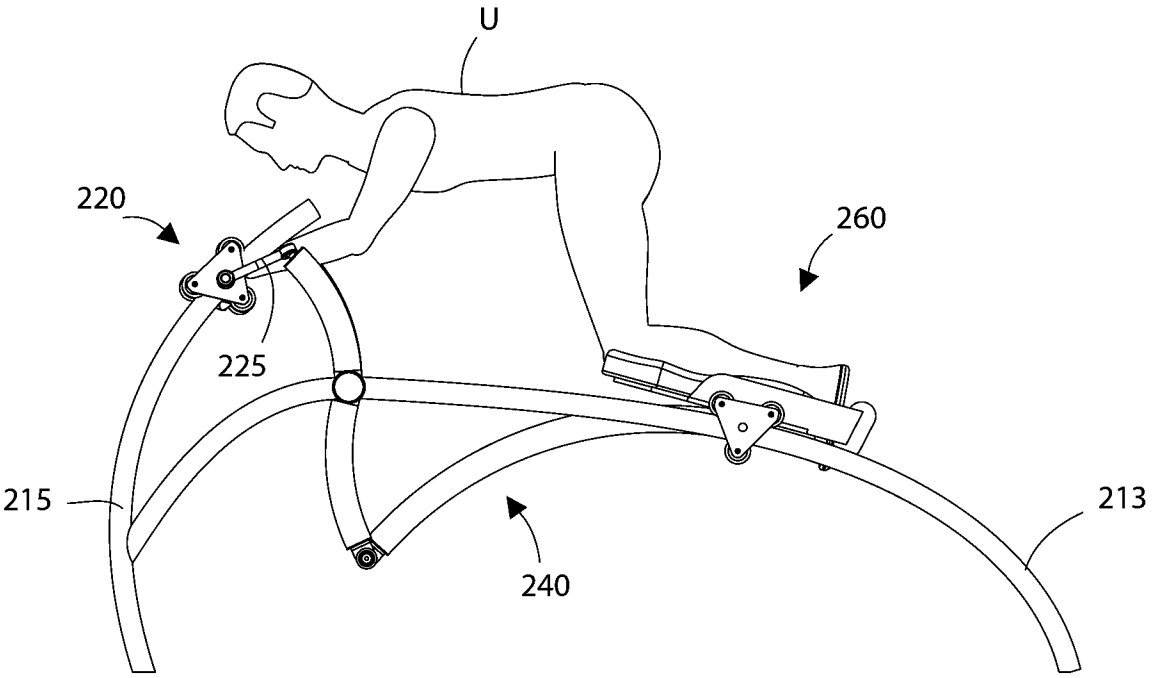
FIG. 9 is a side view of an alternate embodiment of the invention in the at rest and unactivated position showing a user mounted on the machine that is a combination of a lower body user support slidably connected to a set of curved rails and two upper body user supports slidably connected to a set of curved and converging rails wherein the upper body user supports and the lower body user support are operatively connected via a multi-link linkage system that is rotatable around a rotatable central axle.
Figure 10:
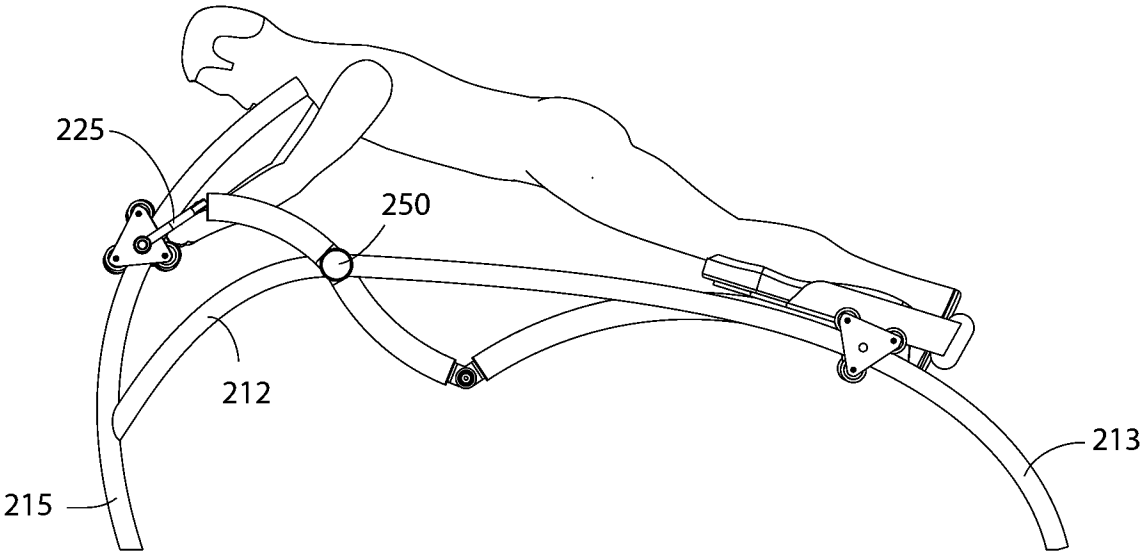
FIG. 10 is a side view of an alternate embodiment of the invention in the extended and activated position showing a user mounted on the machine that is a combination of a lower body user support slidably connected to a set of curved rails and two upper body user supports slidably connected to a set of curved and converging rails wherein the upper body user supports and the lower body user support are operatively connected via a multi-link linkage system that is rotatable around a rotatable central axle.
Figure 11:
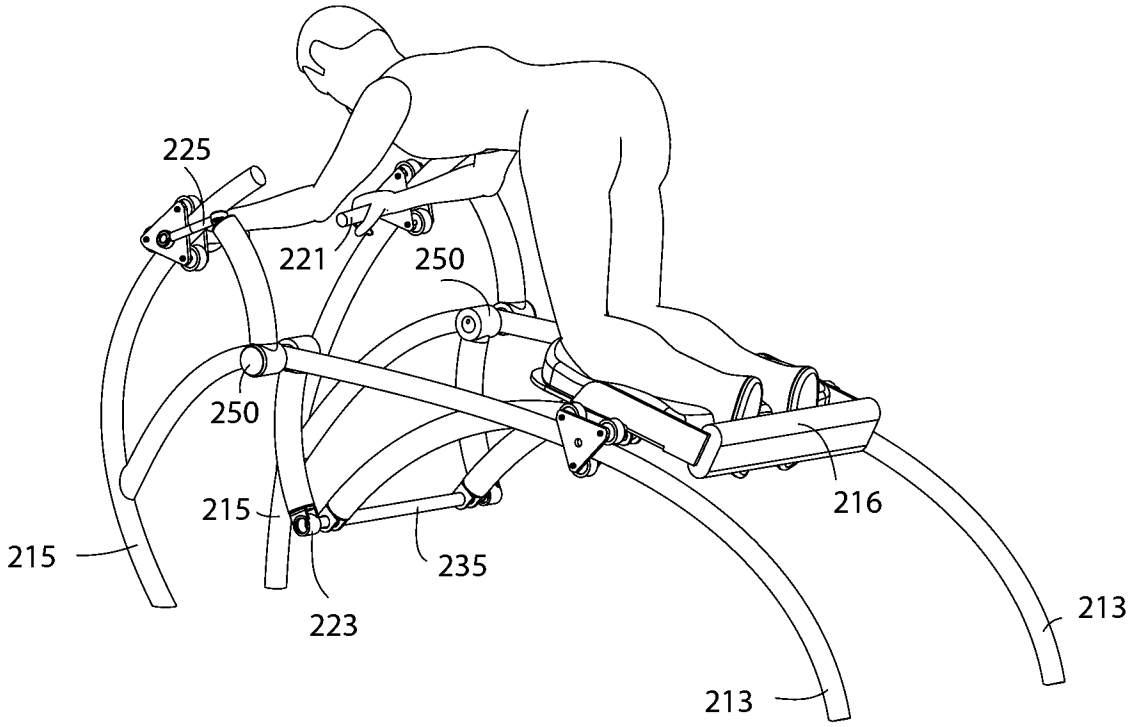
FIG. 11 is a perspective view of an alternate embodiment of the invention in the at rest and unactivated position showing a user mounted on the machine that is a combination of a lower body user support slidably connected to a set of curved rails and two upper body user supports slidably connected to a set of curved and converging rails wherein the upper body user supports and the lower body user support are operatively connected via a multi-link linkage system that is rotatable around a rotatable central axle.
Figure 12:
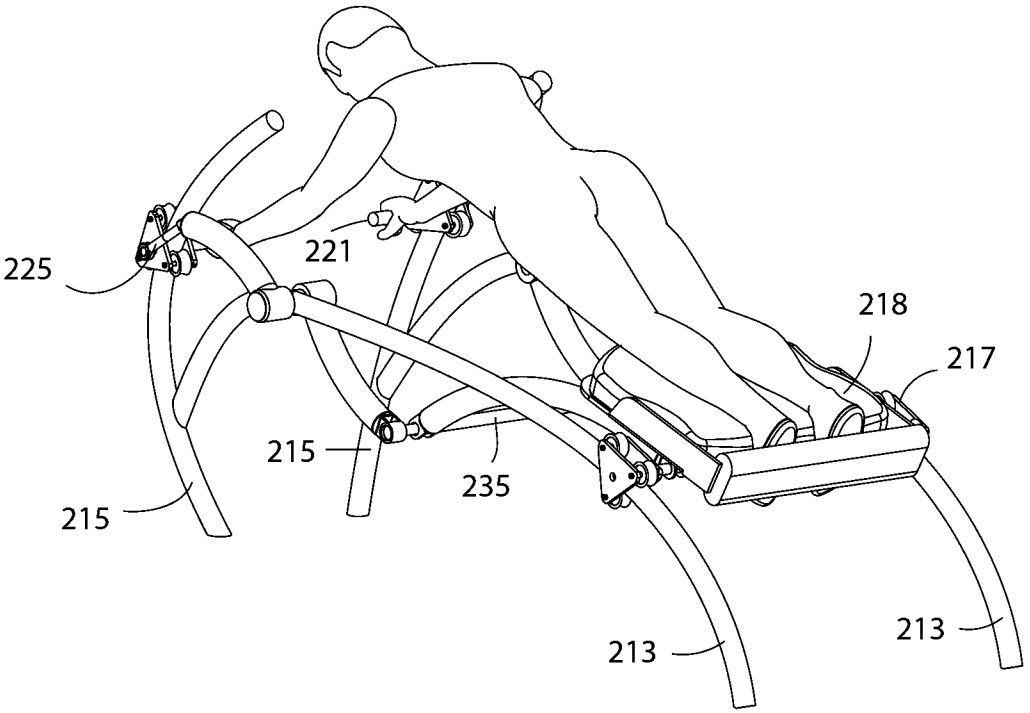
FIG. 12 is a perspective view of an alternate embodiment of the invention in the extended and activated position showing a user mounted on the machine that is a combination of a lower body user support slidably connected to a set of curved rails and two upper body user supports slidably connected to a set of curved and converging rails wherein the upper body user supports and the lower body user support are operatively connected via a multi-link linkage system that is rotatable around a rotatable central axle.
Figure 13:
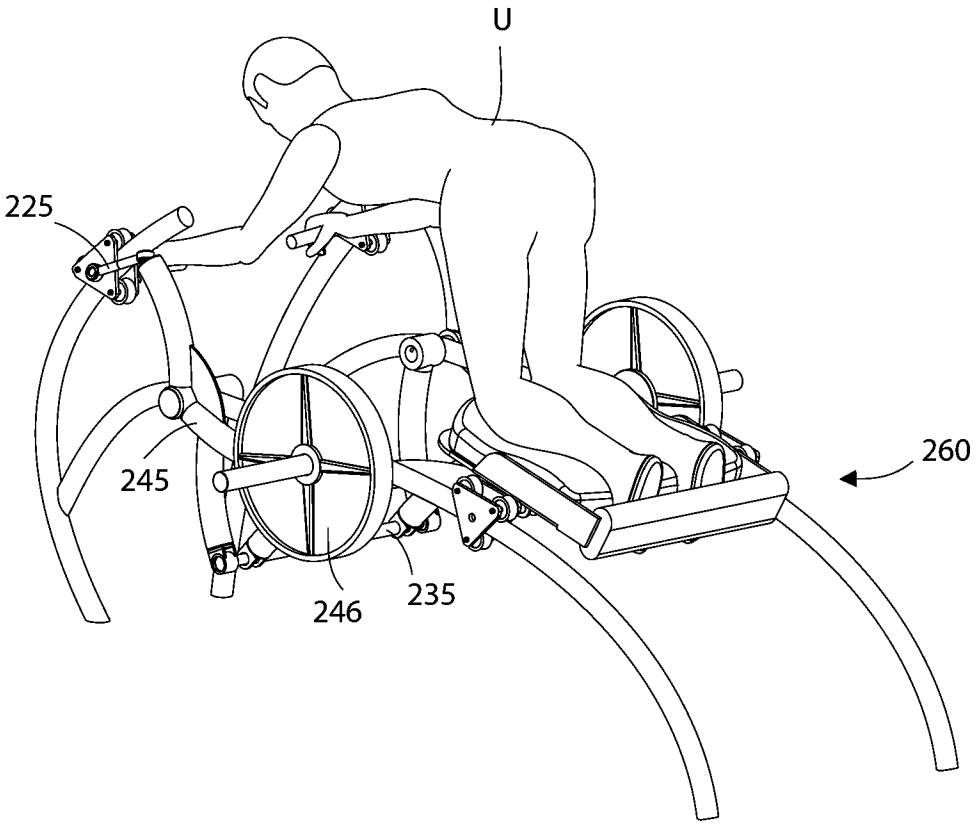
FIG. 13 is a perspective view of an alternate embodiment of the invention in the at rest and unactivated position showing a user mounted on the machine that is a combination of a lower body user support slidably connected to a set of curved rails and two upper body user supports slidably connected to a set of curved and converging rails wherein the upper body user supports and the lower body user support are operatively connected via a multi-link linkage system that is rotatable around a rotatable central axle and a resistance arm is rigidly attached to the rotatable central axle.
Figure 14:
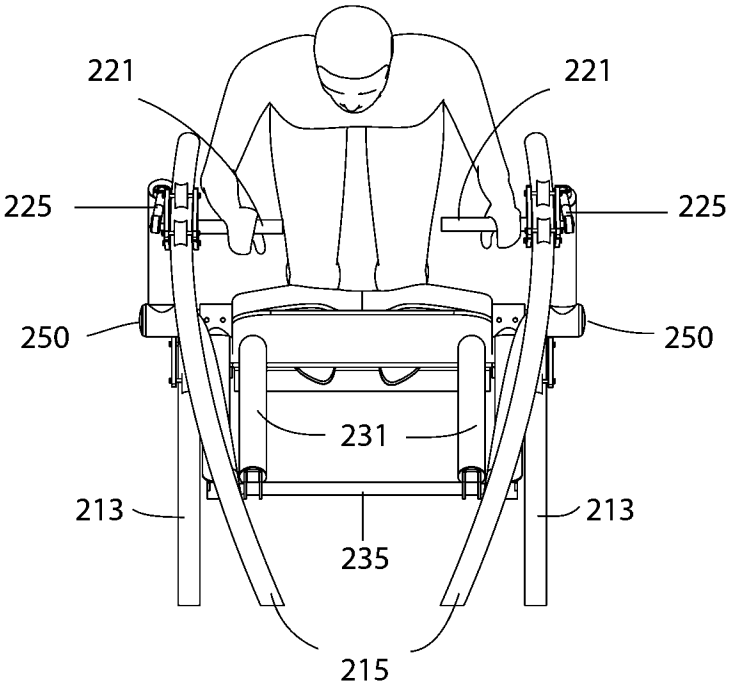
FIG. 14 is a front view of an alternate embodiment of the invention in the at rest and unactivated position showing a user mounted on the machine that is a combination of a lower body user support slidably connected to a set of curved rails and two upper body user supports slidably connected to a set of curved and converging rails wherein the upper body user supports and the lower body user support are operatively connected via a multi-link linkage system that is rotatable around a rotatable central axle.
Figure 15:
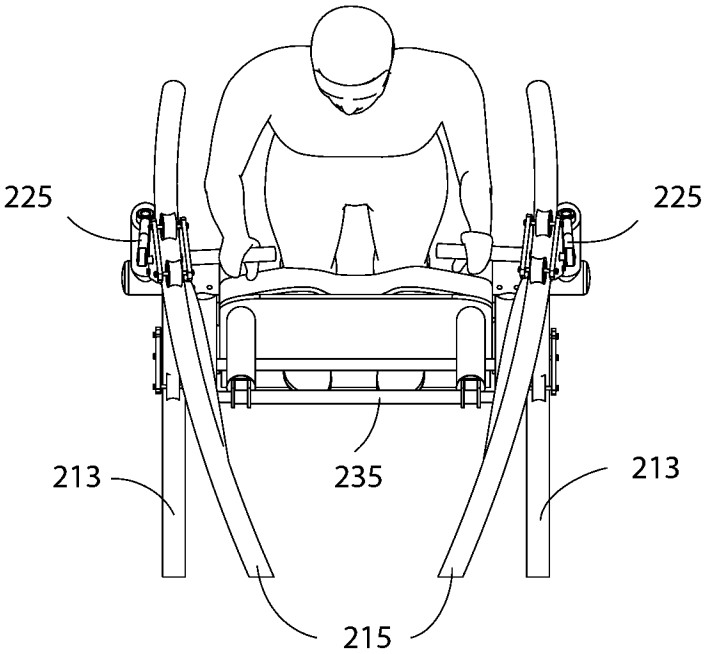
FIG. 15 is a front view of an alternate embodiment of the invention in the extended and activated position showing a user mounted on the machine that is a combination of a lower body user support slidably connected to a set of curved rails and two upper body user supports slidably connected to a set of curved and converging rails wherein the upper body user supports and the lower body user support are operatively connected via a multi-link linkage system that is rotatable around a rotatable central axle.

FIG. 9 is a side view of an alternate, third embodiment with a user mounted on the machine in the at rest position illustrating the slidable upper body user support mounted on curved and converging rails and the lower body user support mounted on curved rails wherein the user supports are operatively connected via a multi-link linkage system that is rotatable around a rotatable central axle. FIG. 10 is a side view of an alternate, third embodiment with a user mounted on the machine in the extended and activated position illustrating the slidable upper body user support mounted on curved and converging rails and the lower body user support mounted on curved rails wherein the user supports are operatively connected via a multi-link linkage system that is rotatable around a rotatable central axle. FIG. 11 is a perspective view of an alternate, third embodiment with a user mounted on the machine in the at rest position illustrating the slidable upper body user support mounted on curved and converging rails and the lower body user support mounted on curved rails wherein the user supports are operatively connected via a multi-link linkage system that is rotatable around a rotatable central axle. FIG. 12 is a perspective view of an alternate, third embodiment with a user mounted on the machine in the extended and activated position illustrating the slidable upper body user support mounted on curved and converging rails and the lower body user support mounted on curved rails wherein the user supports are operatively connected via a multi-link linkage system that is rotatable around a rotatable central axle. FIG. 13 is a perspective view of an alternate, third embodiment with a user mounted on the machine in the at rest position illustrating the slidable upper body user support mounted on curved and converging rails and the lower body user support mounted on curved rails wherein the user supports are operatively connected via a multi-link linkage system that is rotatable around a rotatable central axle with resistance arms rigidly attached to the rotatable central axles. FIG. 14 is a front view of an alternate, third embodiment with a user mounted on the machine in the at rest position illustrating the slidable upper body user support mounted on curved and converging rails and the lower body user support mounted on curved rails wherein the user supports are operatively connected via a multi-link linkage system that is rotatable around a rotatable central axle. FIG. 15 is a front view of an alternate, third embodiment with a user mounted on the machine in the extended and activated position illustrating the slidable upper body user support mounted on curved and converging rails and the lower body user support mounted on curved rails wherein the user supports are operatively connected via a multi-link linkage system that is rotatable around a rotatable central axle.

Figure 16:
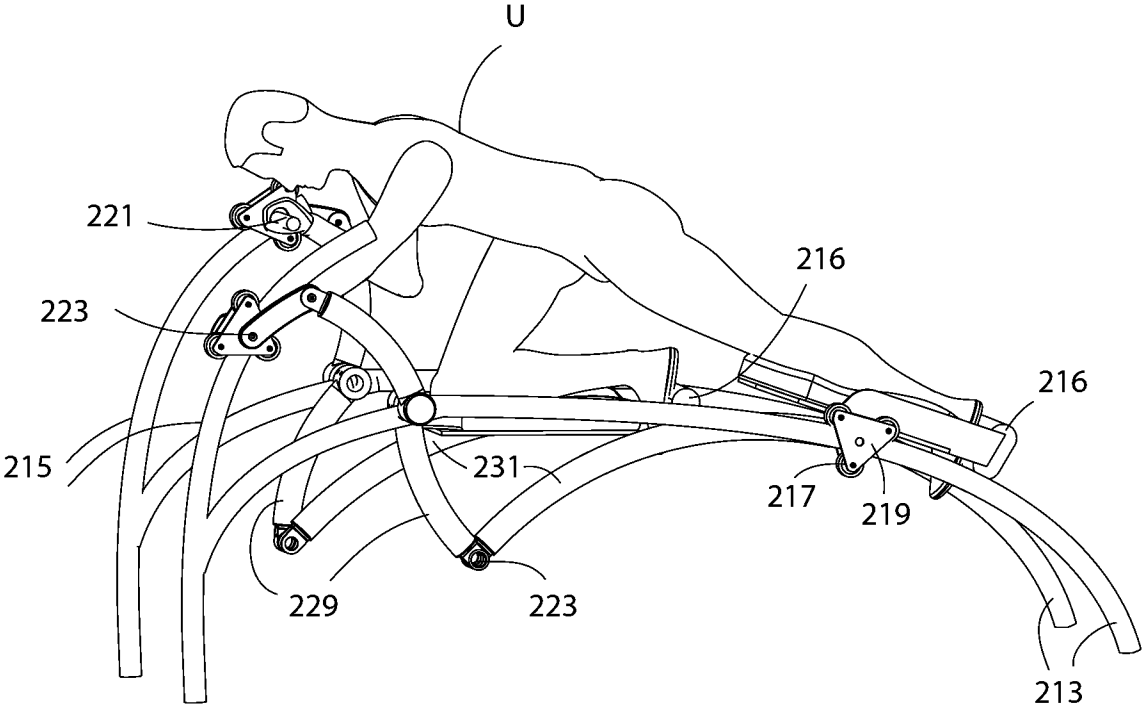
FIG. 16 is a perspective side view of an alternate embodiment of the invention showing a user mounted on the machine that is a combination of a two independent lower body user supports slidably connected to a set of curved rails and two independent upper body user supports slidably connected to a set of curved rails wherein the left side upper body user support and the left side lower body user support are operatively connected via a multi-link linkage system that is rotatable around a rotatable central axle. Opposingly, the right side upper body user support and the right side lower body user support are operatively connected via a multi-link linkage system that is rotatable around a rotatable central axle. In this view the user's left upper and lower body are in the extended and activated position and the user's right upper and lower body are in the at rest and unactivated position.
Figure 17:
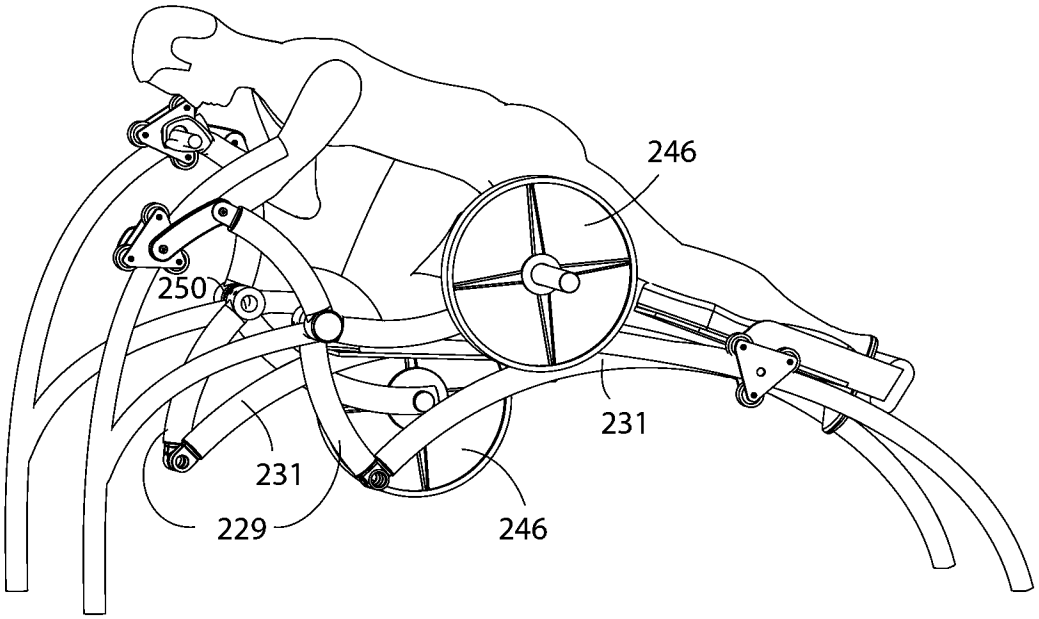
FIG. 17 is a perspective side view of an alternate embodiment of the invention showing a user mounted on the machine that is a combination of a two independent lower body user supports slidably connected to a set of curved rails and two independent upper body user supports slidably connected to a set of curved rails wherein the left side upper body user support and the left side lower body user support are operatively connected via a multi-link linkage system that is rotatable around a rotatable central axle and a resistance arm is rigidly attached to the rotatable central axle. Opposingly, the right side upper body user support and the right side lower body user support are operatively connected via a multi-link linkage system that is rotatable around a rotatable central axle and a resistance arm is rigidly attached to the rotatable central axle. In this view the user's left upper and lower body are in the extended and activated position and the user's right upper and lower body are in the at rest and unactivated position.

FIG. 16 is a perspective side view of an alternate, fourth embodiment with a user mounted on the machine such that the user's left upper body and left lower body are in the extended and activated position and the user's right upper body and right lower body are in the at rest position illustrating two independent upper body supports and two independent lower body user supports each mounted on curved rails wherein the left upper body user support and left lower body user support are operatively connected via a multi-link linkage system that is rotatable around a rotatable central axle and the right upper body user support and the right lower body user support are operatively connected via a multi-link linkage system that is rotatable around a rotatable central axle. FIG. 17 is a perspective side view of an alternate, fourth embodiment with a user mounted on the machine such that the user's left upper body and left lower body are in the extended and activated position and the user's right upper body and right lower body are in the at rest position illustrating two independent upper body supports and two independent lower body user supports each mounted on curved rails wherein the left upper body user support and left lower body user support are operatively connected via a multi-link linkage system that is rotatable around a rotatable central axle with a resistance arm rigidly attached to the left rotatable central axle and the right upper body user support and the right lower body user support are operatively connected via a multi-link linkage system that is rotatable around a rotatable central axle with a resistance arm rigidly attached to the right rotatable central axle.

Figure 18:
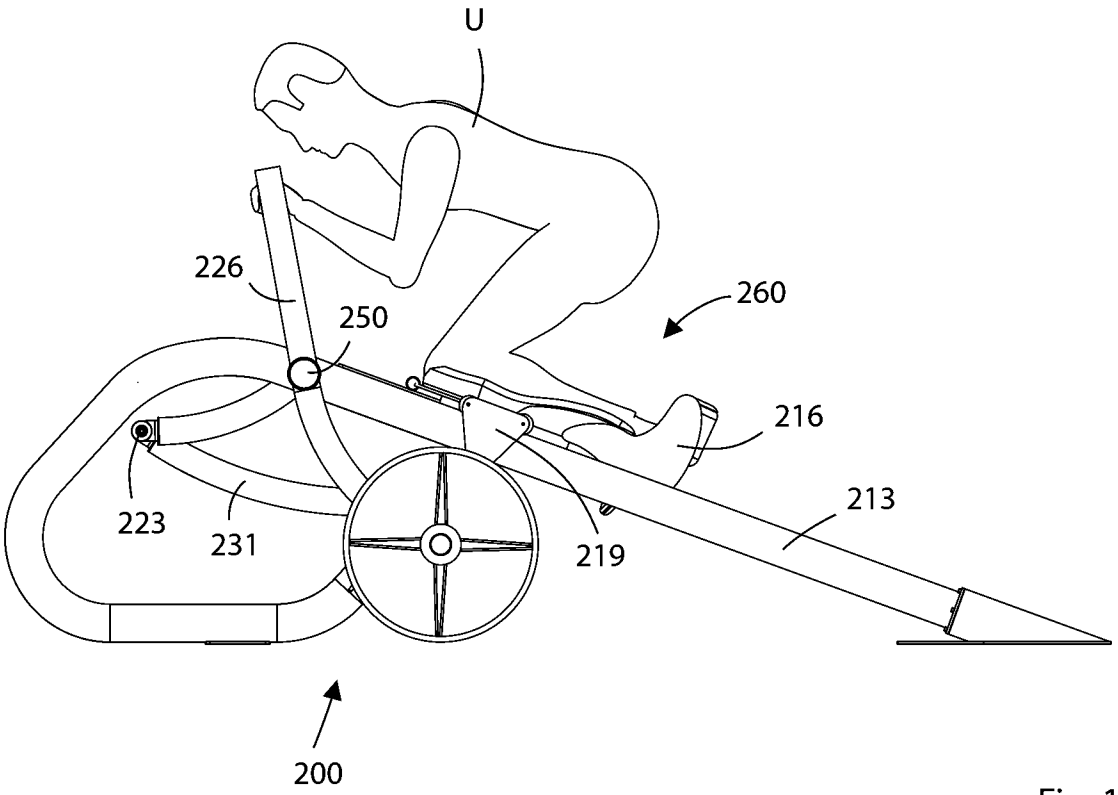
FIG. 18 is a side view of an alternate embodiment of the invention showing a user mounted on the machine in the at rest and unactivated position that is a combination of lower body user support slidably connected to a support rail and a pivotable upper body user support rigidly connected to a central rotatable axle wherein the upper body user support and the lower body user support are operatively connected via a multi-link linkage system that is rotatable around a rotatable central axle and a resistance arm is rigidly attached to the rotatable central axle.
Figure 19:
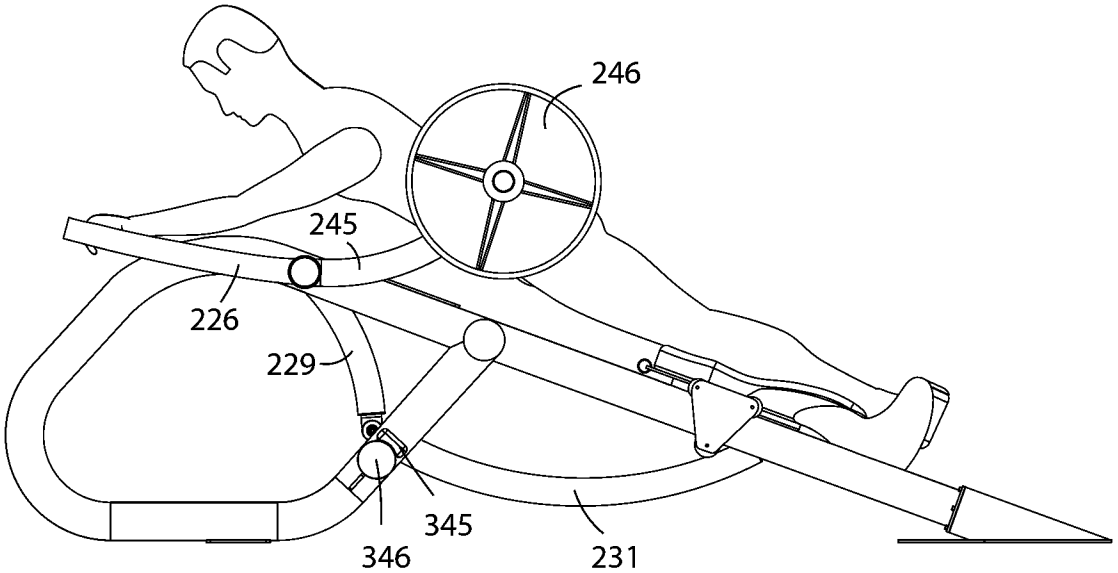
FIG. 19 is a side view of an alternate embodiment of the invention showing a user mounted on the machine in the extended and activated position that is a combination of lower body user support slidably connected to a support rail and a pivotable upper body user support rigidly connected to a central rotatable axle wherein the upper body user support and the lower body user support are operatively connected via a multi-link linkage system that is rotatable around a rotatable central axle and a resistance arm is rigidly attached to the rotatable central axle.
Figure 20:
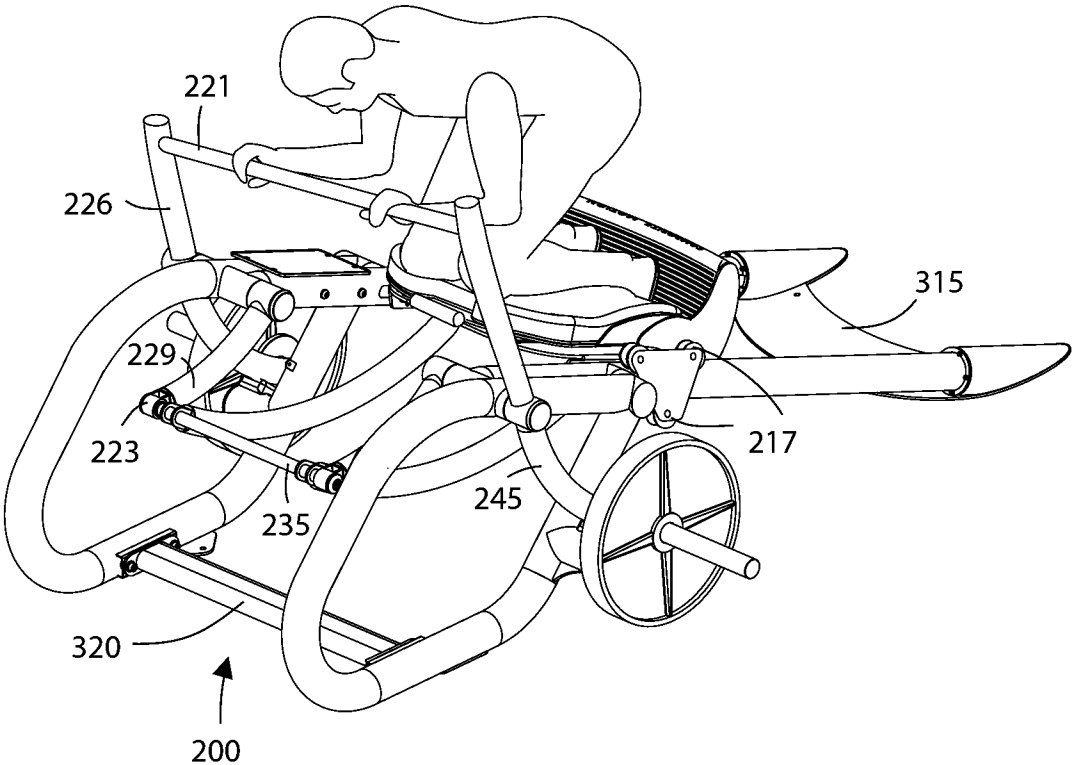
FIG. 20 is a perspective view of an alternate embodiment of the invention showing a user mounted on the machine in the at rest and unactivated position that is a combination of lower body user support slidably connected to a support rail and a pivotable upper body user support rigidly connected to a central rotatable axle wherein the upper body user support and the lower body user support are operatively connected via a multi-link linkage system that is rotatable around a rotatable central axle and a resistance arm is rigidly attached to the rotatable central axle.
Figure 21:
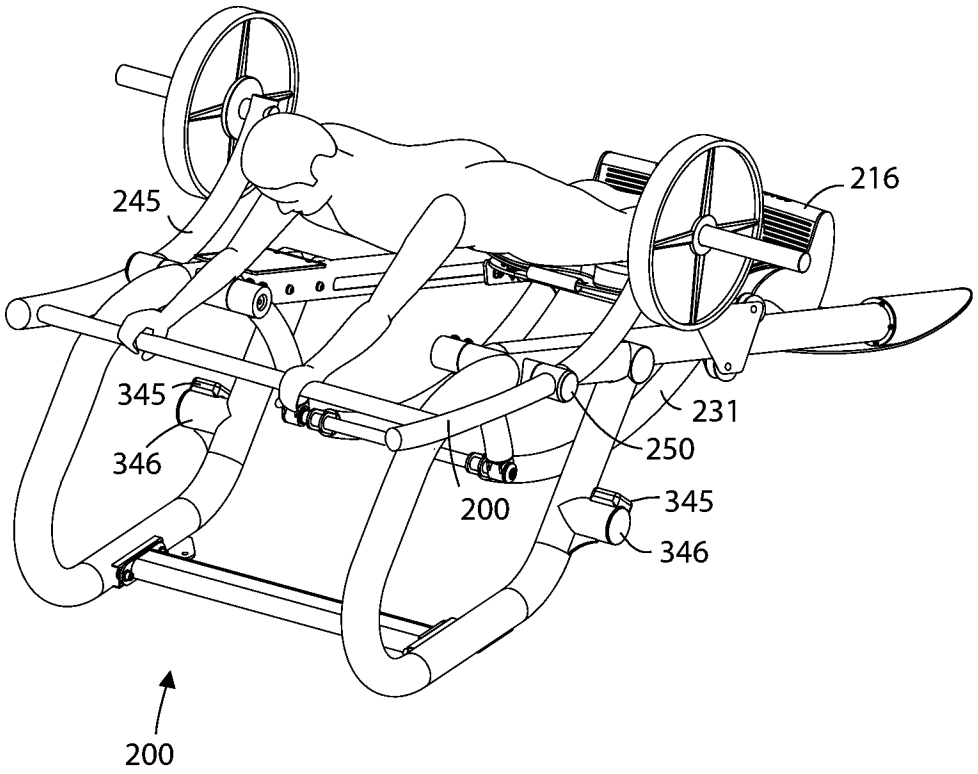
FIG. 21 is a perspective view of an alternate embodiment of the invention showing a user mounted on the machine in the activated and extended position that is a combination of lower body user support slidably connected to a support rail and a pivotable upper body user support rigidly connected to a central rotatable axle wherein the upper body user support and the lower body user support are operatively connected via a multi-link linkage system that is rotatable around a rotatable central axle and a resistance arm is rigidly attached to the rotatable central axle.

FIG. 18 is a side view of an alternate, fifth embodiment with a user mounted on the machine in the at rest position illustrating a pivotable upper body user support and slidable lower body user support mounted on slide rails wherein the user supports are operatively connected via a multi-link linkage system that is rotatable around a rotatable central axle with a resistance arm rigidly attached to the rotatable central axle. FIG. 19 is a side view of an alternate, fifth embodiment with a user mounted on the machine in the extended and activated position illustrating a pivotable upper body user support and slidable lower body user support mounted on slide rails wherein the user supports are operatively connected via a multi-link linkage system that is rotatable around a rotatable central axle with a resistance arm rigidly attached to the rotatable central axle. FIG. 20 is a perspective view of an alternate, fifth embodiment with a user mounted on the machine in the at rest position illustrating a pivotable upper body user support and slidable lower body user support mounted on slide rails wherein the user supports are operatively connected via a multi-link linkage system that is rotatable around a rotatable central axle with resistance arms rigidly attached to the rotatable central axles. FIG. 21 is a perspective view of an alternate, fifth embodiment with a user mounted on the machine in the extended and activated position illustrating a pivotable upper body user support and slidable lower body user support mounted on slide rails and the user supports are operatively connected via a multi-link linkage system that is rotatable around a rotatable central axle with resistance arms rigidly attached to the rotatable central axles.

Figure 22:
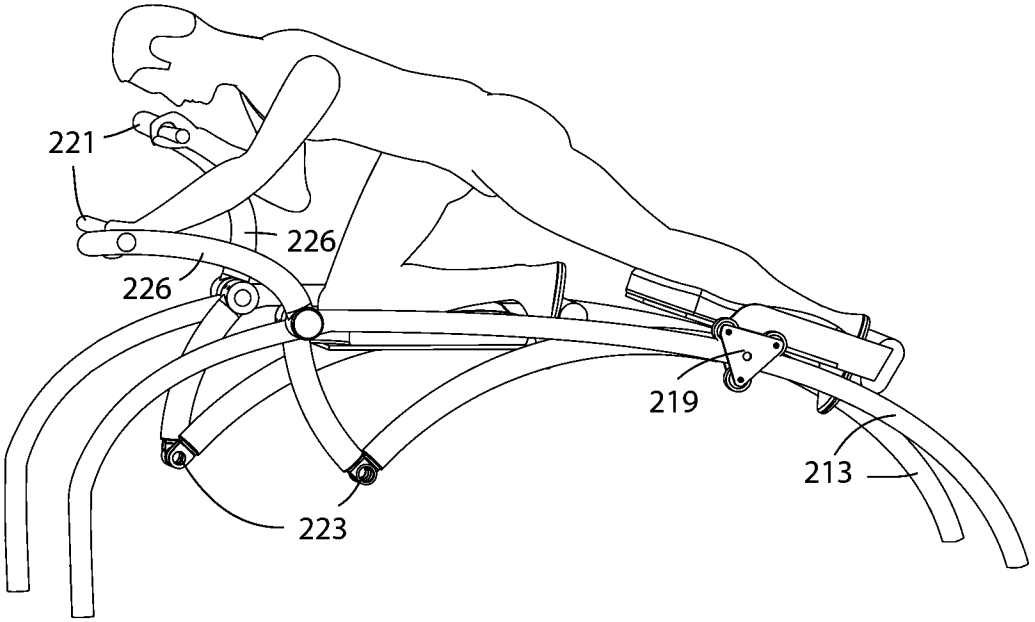
FIG. 22 is a perspective view of an alternate embodiment of the invention showing a user mounted on the machine that is a combination of a two independent lower body user supports slidably connected to a set of curved rails and two independent pivotable upper body user supports rigidly connected to a central rotatable axle wherein the left side upper body user support and the left side lower body user support are operatively connected via a multi-link linkage system that is rotatable around a rotatable central axle. Opposingly, the right side upper body user support and the right side lower body user support are operatively connected via a multi-link linkage system that is rotatable around a rotatable central axle. In this view the user's left upper and lower body are in the extended and activated position and the user's right upper and lower body are in the at rest and unactivated position.

FIG. 22 is a side view of an alternate, sixth embodiment with a user mounted on the machine such that the user's left upper body and left lower body are in the extended and activated position and the user's right upper body and right lower body are in the at rest position illustrating two independent pivotable upper body supports and two independent slidable lower body user supports mounted on curved rails wherein the left upper body user support and left lower body user support are operatively connected via a multi-link linkage system that is rotatable around a rotatable central axle and the right upper body user support and the right lower body user support are operatively connected via a multi-link linkage system that is rotatable around a rotatable central axle.

Figure 23:
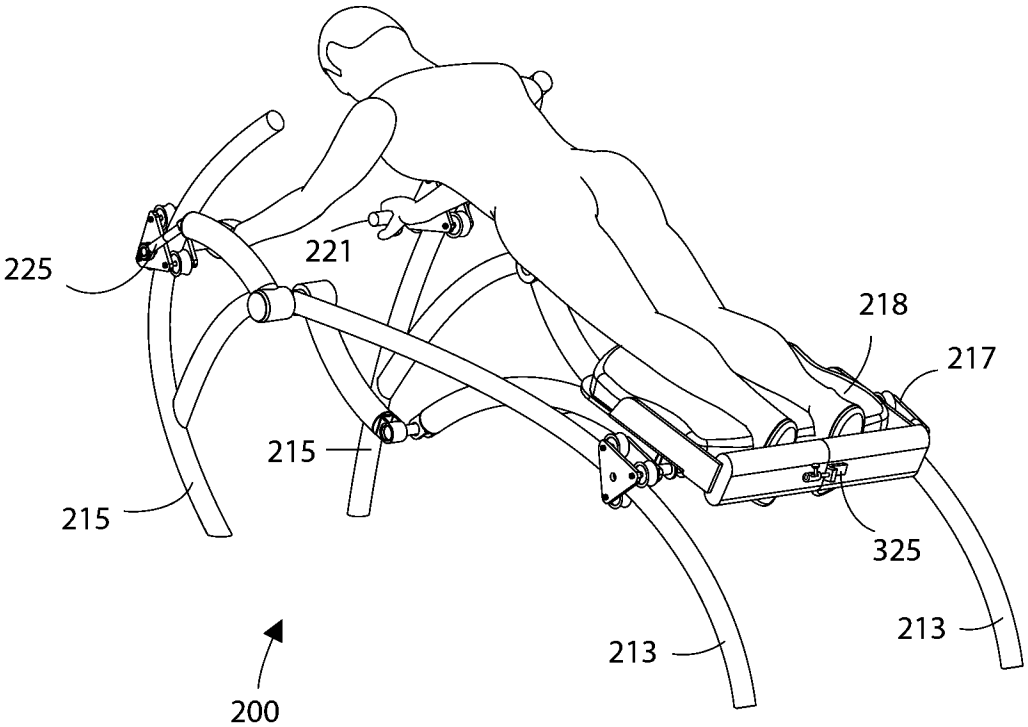
FIG. 23 is a perspective view of an alternate embodiment of the invention in the extended and activated position showing a user mounted on the machine that is a combination of a two independent lower body user supports that are latched together to move in unison and are slidably connected to a set of curved rails and two upper body user supports slidably connected to a set of curved and converging rails wherein the left side upper body user supports and the lower body user support are operatively connected via a multi-link linkage system that is rotatable around a rotatable central axle and the right side upper body user supports and the lower body user support are operatively connected via a multi-link linkage system that is rotatable around a rotatable central axle.

FIG. 23 is a perspective view of an alternate, seventh embodiment with a user mounted on the machine in the activated position illustrating the two independent slidable upper body user supports mounted on curved and converging rails and two independent lower body user supports latched together and mounted on curved rails wherein the left upper body user support and the left lower body user support are operatively connected via a multi-link linkage system that is rotatable around a rotatable central axle. In this embodiment, the right upper body user support and the right lower body user support are operatively connected via a multi-link linkage system that is rotatable around a rotatable central axle and that can be latched together for dependent motion.

Figure 24:
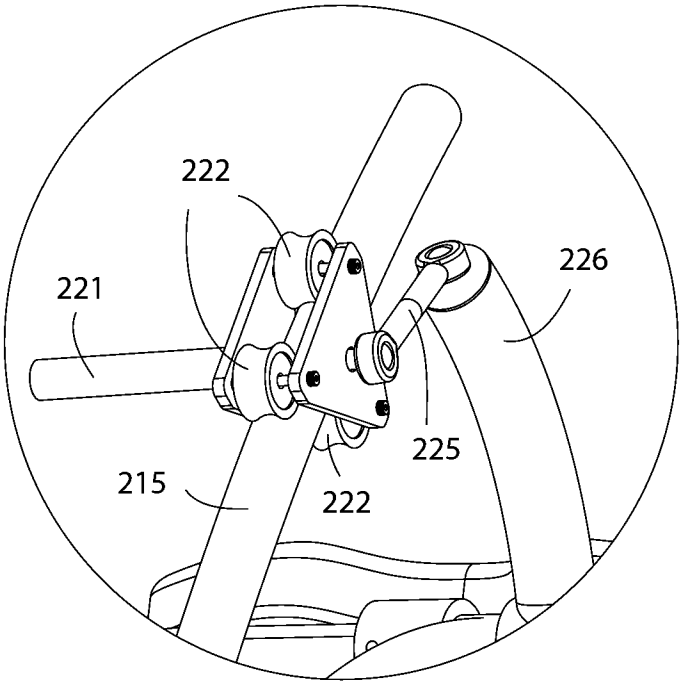
FIG. 24 is a perspective detail view of a slidable upper body user support assembly and traveling member connected to the multi-link linkage system via a ball joint ended link bar.
Figure 25:
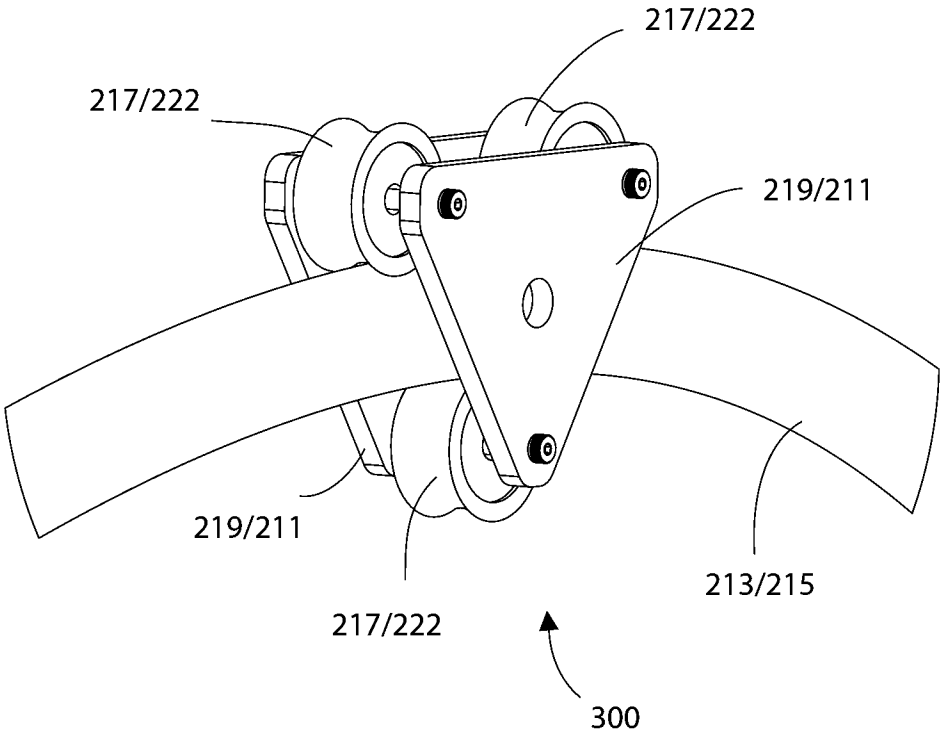
FIG. 25 is a perspective detail view of the user support transport system traveling member configured as a set of concave wheels that capture and roll on a curved support slide rail.

FIG. 24 is a perspective detail view illustrating a feature contained in multiple embodiments, namely, a slidable upper body user support assembly connected to the multi-link linkage system via a multi-directional ball joint ended link bar. FIG. 25 is a perspective detail view illustrating a feature contained in multiple embodiments, namely, a user support transport system traveling member 300 configured as a set of concave wheels that capture and roll on a support slide rail.

Figure 26:
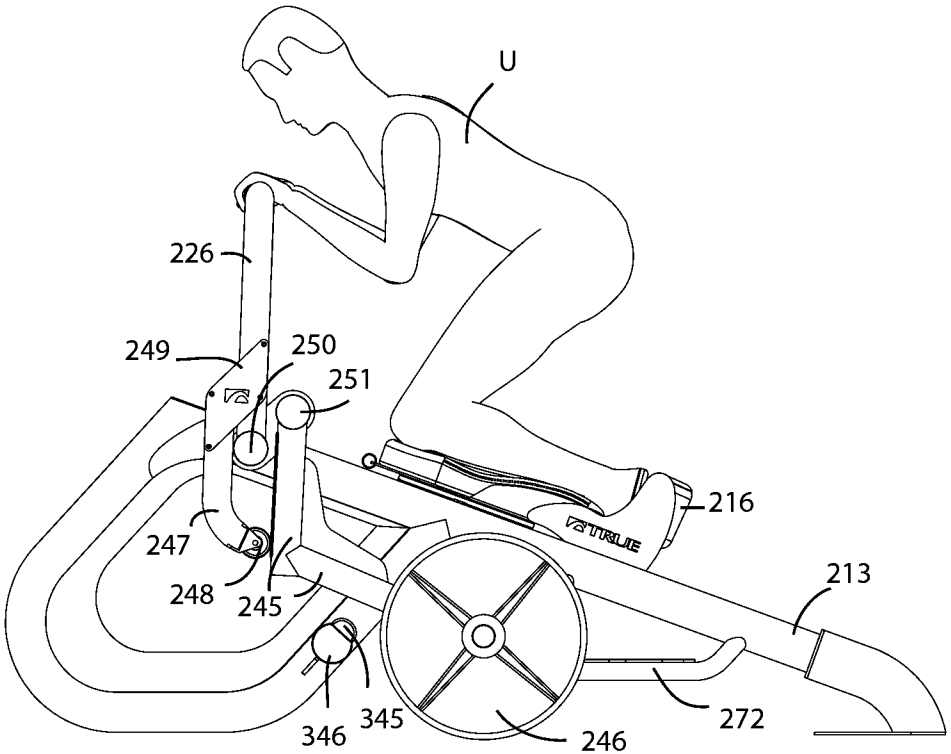
FIG. 26 is a side view of a preferred embodiment of the invention showing a user mounted on the machine in the at rest and unactivated position that is a combination of lower body user support slidably connected to a support rail and a pivotable upper body user support rigidly connected to a central rotatable axle wherein the upper body user support and the lower body user support are operatively connected via a multi-link linkage system that is rotatable around a rotatable central axle and the rotatable central axle is operatively connected to a resistance weight arm via a rotatable variable torque lever arm.
Figure 27:
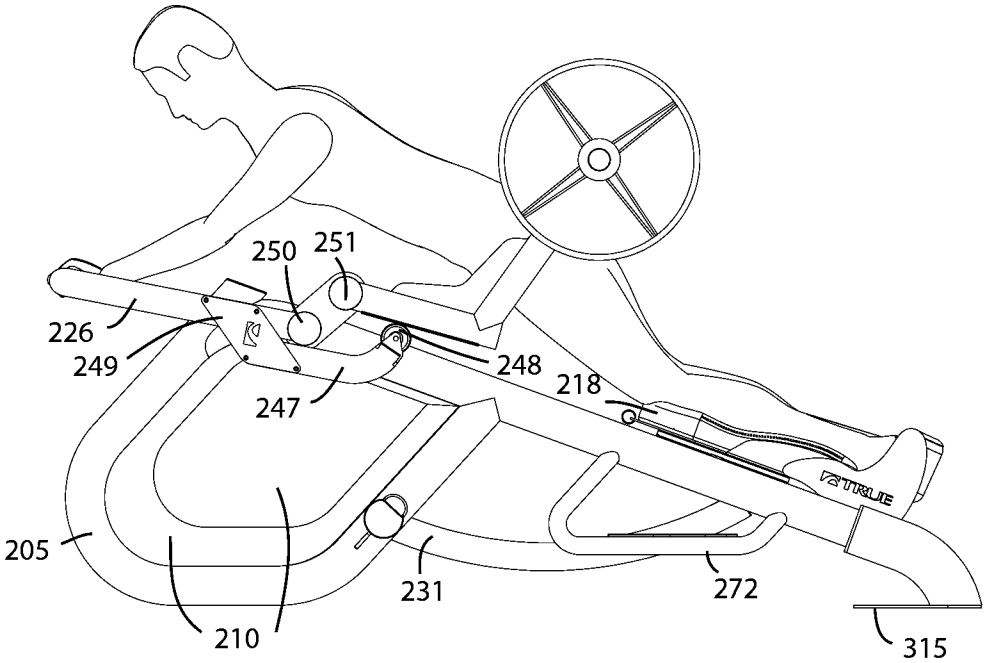
FIG. 27 is a side view of a preferred embodiment of the invention showing a user mounted on the machine in the extended and activated position that is a combination of lower body user support slidably connected to a support rail and a pivotable upper body user support rigidly connected to a central rotatable axle wherein the upper body user support and the lower body user support are operatively connected via a multi-link linkage system that is rotatable around a rotatable central axle and the rotatable central axle is operatively connected to a resistance weight arm via a rotatable variable torque lever arm.
Figure 28:
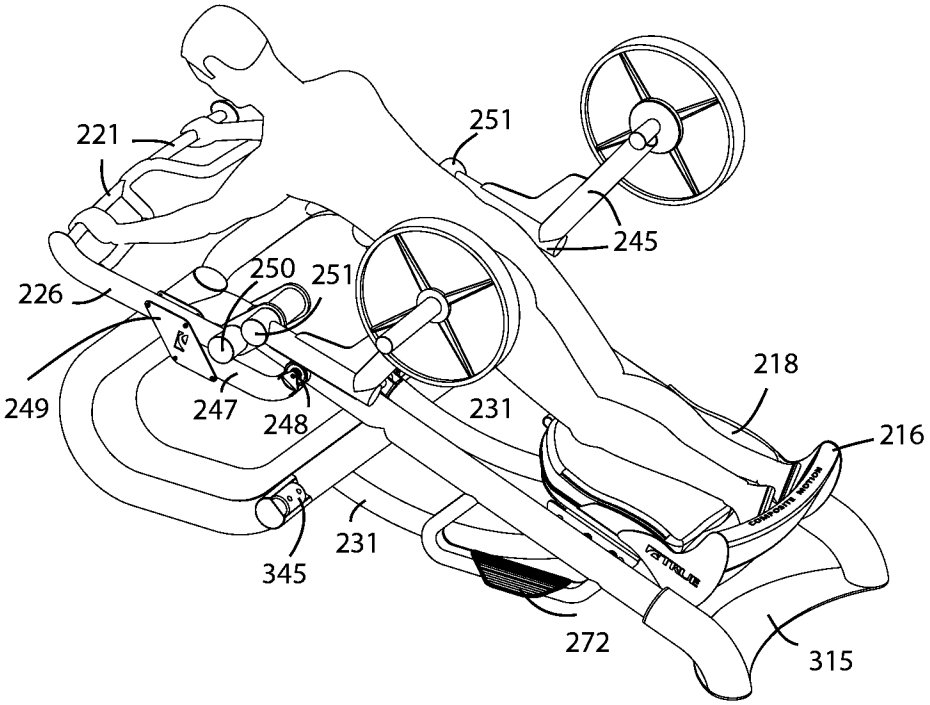
FIG. 28 is a perspective view of a preferred embodiment of the invention showing a user mounted on the machine in the extended and activated position that is a combination of lower body user support slidably connected to a support rail and a pivotable upper body user support rigidly connected to a central rotatable axle wherein the upper body user support and the lower body user support are operatively connected via a multi-link linkage system that is rotatable around a rotatable central axle and the rotatable central axle is operatively connected to a resistance weight arm via a rotatable variable torque lever arm.
Figure 29:
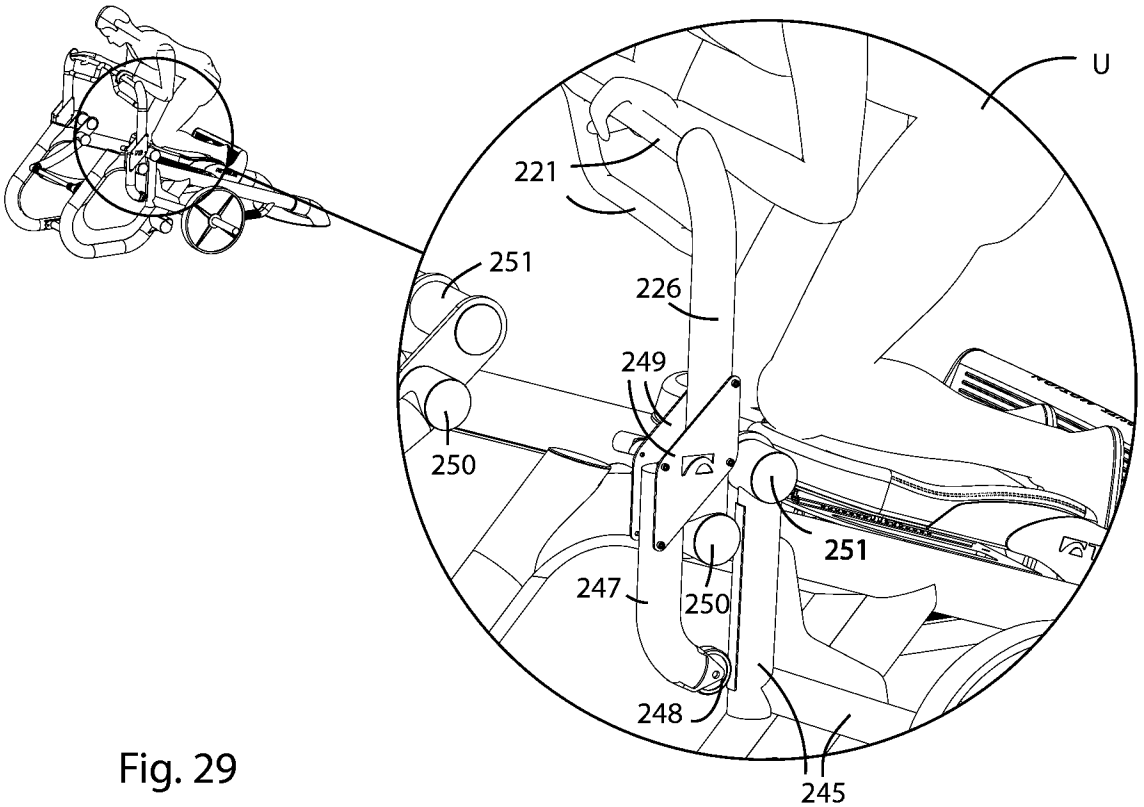
FIG. 29 is a perspective detail view of a variable torque dual lever arm resistance mechanism developed for the present invention.

FIG. 26 is a side view of a preferred embodiment with a user mounted on the machine in the at rest position illustrating a pivotable upper body user support and slidable lower body user support mounted on slide rails wherein the user supports are operatively connected via a multi-link linkage system that is rotatable around a rotatable central axle and the rotatable central axle is operatively connected to a resistance weight arm via a rotatable variable torque lever arm. FIG. 27 is a side view of this preferred embodiment with a user mounted on the machine in the extended and activated position illustrating a pivotable upper body user support and slidable lower body user support mounted on slide rails wherein the user supports are operatively connected via a multi-link linkage system that is rotatable around a rotatable central axle and the rotatable central axle is operatively connected to a resistance weight arm via a rotatable variable torque lever arm. FIG. 28 is a perspective view of this preferred embodiment with a user mounted on the machine in the extended and activated position illustrating a pivotable upper body user support and slidable lower body user support mounted on slide rails wherein the user supports are operatively connected via a multi-link linkage system that is rotatable around a rotatable central axle and the rotatable central axle is operatively connected to a resistance weight arm via a rotatable variable torque lever arm. FIG. 29 is a perspective detail view illustrating the resistance mechanism of the preferred embodiment, which is a variable torque dual lever arm resistance mechanism developed for the present invention.

Figure 30:
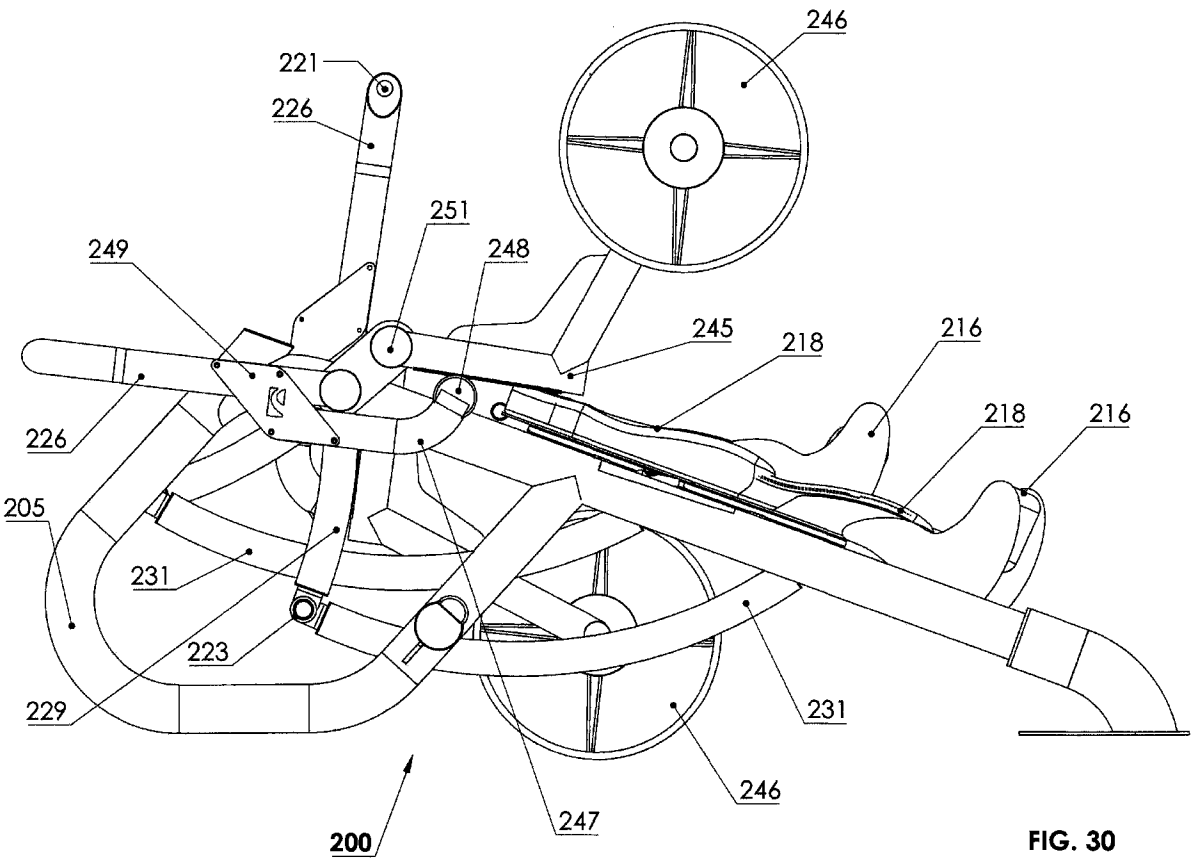
FIG. 30 is a side view of a preferred embodiment of the invention showing a machine that is a combination of two independent left and right lower body user supports slidably connected to a set of slide rails and two independent left and right pivotable upper body user supports rigidly connected to left and right side rotatable central axles wherein the rotatable central axles are operatively connected to left and right side rotatable resistance weight arms via left and right side rotatable variable torque lever arms and the left side upper body user support and the left side lower body user support are operatively connected via a multi-link linkage system that is rotatable around a left side rotatable central axle. Opposingly, the right side upper body user support and the right side lower body user support are operatively connected via a multi-link linkage system that is rotatable around a right side rotatable central axle. In this view the left upper and lower body user supports are in the extended and activated position and the right upper and lower body user supports are in the at rest and unactivated position.

FIG. 30 is a side view of this preferred embodiment of the machine where the left upper body and left lower body user supports are in the extended and activated position and the right upper body and right lower body user supports are in the at rest position illustrating two independent pivotable upper body supports and two independent slidable lower body user supports mounted on slide rails. In this view, the left upper body user support and left lower body user support are operatively connected via a left multi-link linkage system that is rotatable around a left rotatable central axle and the left rotatable central axle is operatively connected to a left rotatable resistance weight arm via a left rotatable variable torque lever arm. Similarly, the right upper body user support and the right lower body user support are operatively connected via a right multi-link linkage system that is rotatable around a right rotatable central axle and the right rotatable central axle is operatively connected to a right rotatable resistance weight arm via a right rotatable variable torque lever arm.

Figure 31:
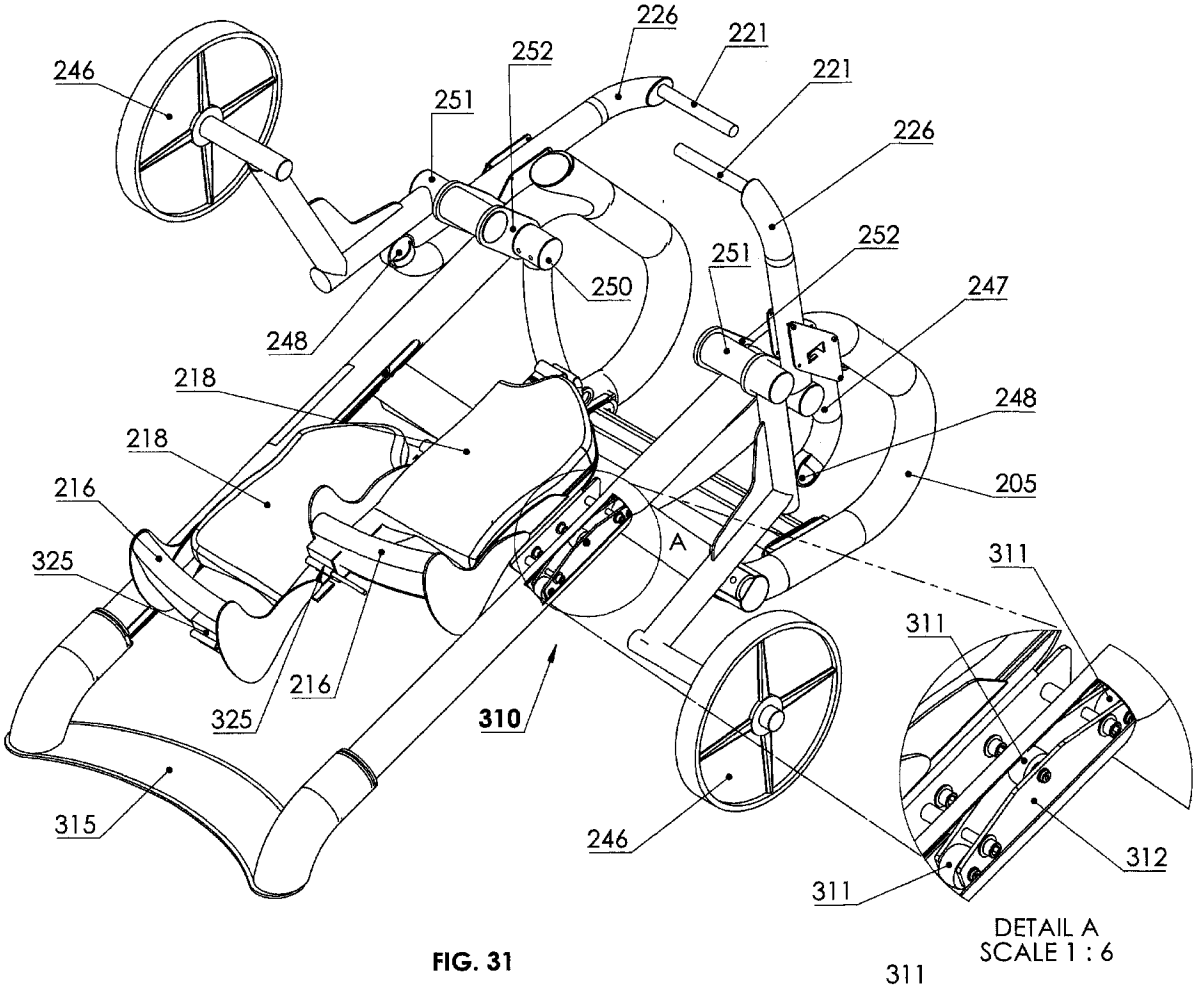
FIG. 31 is a perspective exploded view of a preferred embodiment of the invention showing a machine that is a combination of two independent left and right lower body user supports slidably connected to a set of slide rails and two independent left and right pivotable upper body user supports rigidly connected to left and right side rotatable central axles wherein the rotatable central axles are operatively connected to left and right side rotatable resistance weight arms via left and right side rotatable variable torque lever arms and the left side upper body user support and the left side lower body user support are operatively connected via a multi-link linkage system that is rotatable around a left side rotatable central axle. Opposingly, the right side upper body user support and the right side lower body user support are operatively connected via a multi-link linkage system that is rotatable around a right side rotatable central axle. In this view the left upper and lower body user supports are in the extended and activated position and the right upper and lower body user supports are in the at rest and unactivated position. The lower body user support transport assembly that is internal to the frame is shown in a cutaway and highlighted detail view.

FIG. 31 is a perspective exploded view of this preferred embodiment of the machine where the left upper body and left lower body user supports are in the extended and activated position and the right upper body and right lower body user supports are in the at rest position illustrating two independent pivotable upper body supports and two independent slidable lower body user supports mounted on slide rails. In this view, the left upper body user support and left lower body user support are operatively connected via a left multi-link linkage system that is rotatable around a left rotatable central axle and the left rotatable central axle is operatively connected to a left rotatable resistance weight arm via a left rotatable variable torque lever arm. Similarly, the right upper body user support and the right lower body user support are operatively connected via a right multi-link linkage system that is rotatable around a right rotatable central axle and the right rotatable central axle is operatively connected to a right rotatable resistance weight arm via a right rotatable variable torque lever arm. In this view, the lower body user support transport assembly that is internal to the frame is shown in a detail cutaway.

Figure 32:
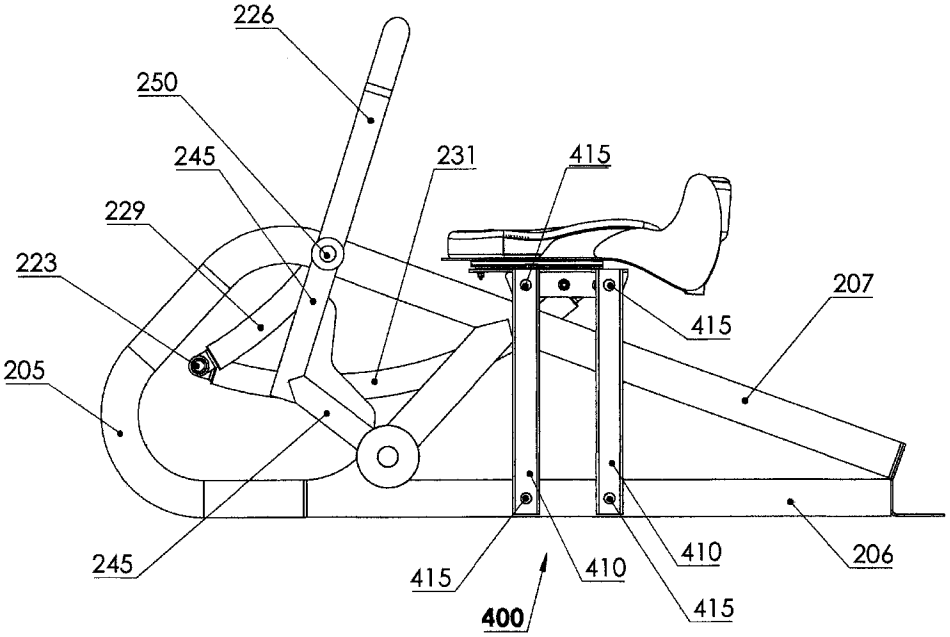
FIG. 32 is a side view of a preferred embodiment of the invention showing a machine in the at rest and unactivated position that is a combination of a lower body user support mounted on a four-bar link pivot assembly and a pivoting upper body user support that are operatively connected via a multi-link linkage system that is rotatable around a central axle and a resistance arm is rigidly attached to the rotatable central axle.
Figure 33:
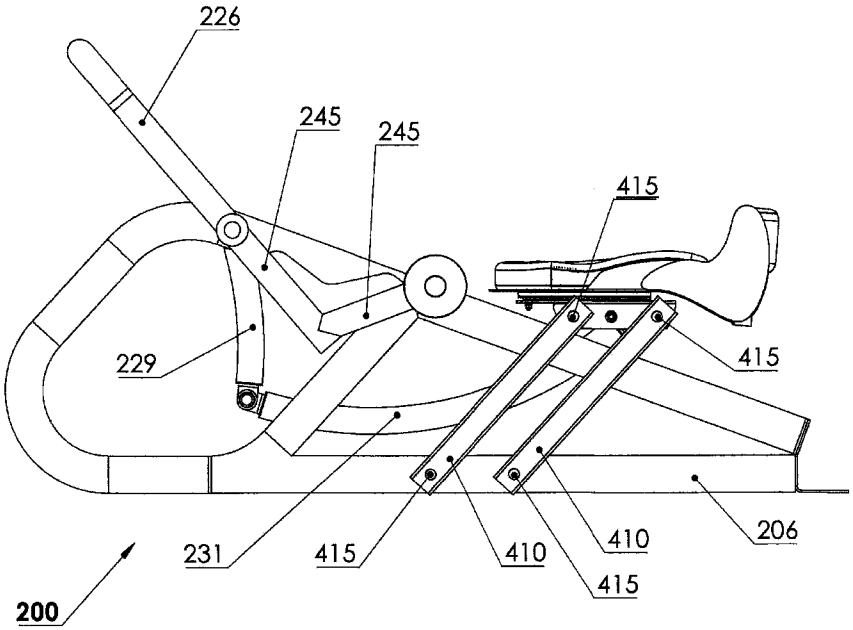
FIG. 33 is a side view of a preferred embodiment of the invention showing a machine in the extended and fully activated position that is a combination of a lower body user support mounted on a four-bar link pivot assembly and a pivoting upper body user support that are operatively connected via a multi-link linkage system that is rotatable around a central axle and a resistance arm is rigidly attached to the rotatable central axle.

FIG. 32 is a side view of this preferred embodiment illustrating the at rest and unactivated position of the machine that is a combination of a lower body user support mounted on a four-bar link pivot assembly and a pivoting upper body user support that are operatively connected via a multi-link linkage system that is rotatable around a central axle and a resistance arm is rigidly attached to the rotatable central axle. FIG. 33 is a side view illustrating the extended and activated position of the machine that is a combination of a lower body user support mounted on a four-bar link pivot assembly and a pivoting upper body user support that are operatively connected via a multi-link linkage system that is rotatable around a central axle and a resistance arm is rigidly attached to the rotatable central axle.

Referring now to FIGS. 1-31, various views of several embodiments of the machine 200 are shown to provide a more complete understanding of the invention. In certain embodiments such as those illustrated in FIGS. 1-17 the machine 200 comprises stationary slide rails 213 and 215 and a lower body user support or supports 260, and an upper body user support or supports 220. Lower body user support 260 and upper body user support 220 are operatively connected by a rotatable linkage system 240 which is attached to a rotatable central axle 250. The machine 200 can be constructed of any suitable material, such as one or more sets of formed or shaped tubes or channels, such as steel or other metals or suitable materials, for supporting the working components of the machine 200. The slide rails 213 and 215 comprise components such as tubes and stands so as to form a stable base adequate to stably support the remainder of the machine 200 and a user U, as well as being able to stably withstand the movement of the machine 200 during use.

The lower body user support 260 is slidably mounted on at least one slide rail 213, which is attached to and supported by at least one slide rail support 212. Lower body user support 260 is structured and mounted on slide rail 213 such that the user U can kneel on the user support 260 while using the machine 200 and slide the lower body user support 260 towards or converging and away from or diverging relative to upper body user support 220.

The upper body user support 220 is slidably mounted on at least one slide rail 215 which is rigidly attached to and braced by slide rail support 212. Upper body user support 220 is structured and mounted on slide rail 215 such that user U can grasp user support 220 and more specifically grip handles 221 while using machine 200 and slide the upper body user support 220 towards or converging and away from or diverging relative to lower body user support 260.

Upper body user support 220 is slidably mounted on slide rail 215 such that the user U can grasp grip handles 221 while using machine 210 and slidably move the upper body user support relative to the user's torso and lower body user support 260. Upper body user support 220 is operatively connected to lower body user support 260 via rotatable multi-link linkage system 240 such that upper body user support 220 and lower body user support 260 cooperate with each other during the exercise regimen.

In other embodiments such as those illustrated in FIGS. 18-22, upper body user support 220 and upper body user support slide rail 215 are omitted and upper body user support grip or grips 221 is directly and rigidly connected to a second end of link bar 226 and a first end of link bar 226 is rigidly connected to central rotational axle 250 such that upper body user support grip 221 and lower body user support 260 are operatively connected and cooperate via rotatable multi-link linkage system 240 during the exercise regimen. Upper body user support grip 221 comprises at least one grip handle of any ergonomically desirable shape, with circular being the most common.

Also as illustrated in FIGS. 18-22, lower body user support or supports 260 are a generally planar or "L"-shaped or "T"-shaped structure on which a user U kneels, and supports a user U during the exercise regimen when using the machine 200. User support or supports 260 is most commonly a simple rectangular or square structure similar to the seat of a chair. Lower body user support 260 also contains a padded structure 218 thereon for the additional comfort of a user U. Lower body user support 260 preferably is of a size, shape, and strength to comfortably or at least adequately support a user U thereon. Lower body user support 260 comprises at least one foot pressing plate 216 of any desirable shape such as curved, angled or flat.

In a preferred embodiment of the invention that is illustrated in FIGS. 26-31, upper body user support 220 and upper body user support slide rail 215 are omitted and upper body user support grip or grips 221 are directly and rigidly connected to a second end of link bar 226, and a first end of link bar 226 is rigidly connected to central rotational axle 250 such that upper body user support grip 221 and lower body user support 260 are operatively connected and cooperate via rotatable multi-link linkage system 240 during the exercise regimen. Also, link bar or bars 226, which are rigidly connected to user support grip or grips 221, are rigidly connected via rotatable torque arm lever mounting bracket or brackets 249 to rotatable torque arm lever or levers 247, and rotatable torque arm lever or levers 247 is operatively connected to resistance weight arm or arms 245 via rotatable torque arm lever wheel or wheels 248, and resistance weight arm or arms 245 is rotatable on resistance weight arm axle or axles 251. Upper body user support grip 221 comprises at least one grip handle of any ergonomically desirable shape, with circular being the most common. In the preferred embodiments as illustrated in FIGS. 26-31, lower body user support or supports 260 is a generally planar or "L"-shaped or "T"-shaped structure on which a user U kneels, and supports a user U during the exercise regimen when using the machine 200. User support or supports 260 is most commonly a simple rectangular or square structure similar to the seat of a chair. Lower body user support or supports 260 also contain a padded structure or structures 218 thereon for the additional comfort of a user U. Lower body user support or supports 260 preferably is of a size, shape, and strength to comfortably or at least adequately support a user U thereon. Lower body user support or supports 260 comprises at least one foot pressing plate or plates 216 of any desirable shape such as curved, angled or flat.

In yet another embodiment as illustrated in FIGS. 32-33, upper body user support 220 and upper body user support slide rail 215 are omitted and upper body user support grip or grips 221 are directly and rigidly connected to a second end of link bar 226 and a first end of link bar 226 is rigidly connected to central rotational axle 250. Also, the lower body user support slide rail is omitted, the lower body user support 260 is mounted on a pivoting four-bar link and lower body user support 260, and upper body user support grips 221 are operatively connected and cooperate via rotatable multi-link linkage system 240 during the exercise regimen. Upper body user support grip 221 comprises at least one grip handle of any ergonomically desirable shape, with circular being the most common.

Also as illustrated in FIGS. 32-33, lower body user support or supports 260 are a generally planar or "L"-shaped or "T"-shaped structure on which a user U kneels, and supports a user U during the exercise regimen when using the machine 200. User support or supports 260 is most commonly a simple rectangular or square structure similar to the seat of a chair. Lower body user support 260 also contains a padded structure 218 thereon for the additional comfort of a user U. Lower body user support 260 preferably is of a size, shape, and strength to comfortably or at least adequately support a user U thereon. Lower body user support 260 comprises at least one foot pressing plate 216 of any desirable shape such as curved, angled or flat.

In each embodiment as illustrated in FIGS. 1-31, lower body user support 260 is operatively connected to upper body user support 220 or upper body user support grip or grips 221 via rotatable multi-link linkage system 240 such that lower body user support 260 and upper body user support 220 and or upper body user support grip or grips 221 cooperate with each other during the exercise regimen.

In certain embodiments such as those illustrated in FIGS. 16-17, 22-23, and 30-31 the machine 200 can comprise two separate lower body user supports 260L and 260R and two separate upper body user supports 220L and 220R and or at least two upper body user support grips 221L and 221R. The machine 200 also can include two separate rotatable multi-link linkage systems 240L and 240R each of which are mounted on two separate rotatable central axles 250L and 250R. In these embodiments lower body user support 260L and upper body user support 220L and or upper body user support grip 221L are operatively connected and independent of lower body user support 260R and upper body user support 220R and or upper body user support grip 221R. Likewise, in these embodiments lower body user support 260R and upper body user support 220R and or upper body user support grip 221R are operatively connected and independent of lower body user support 260L and upper body user support 220L and or upper body user support grip 221L. Additionally, as illustrated in FIGS. 23 and 31 a latching/unlatching mechanism 325 allows the lower body user supports 260L and 260R to be latched together and cooperate as one unit or unlatched so as to operate independently of one another. Latching together lower body user support 260L and lower body user support 260R also would cause upper body user support 220L and or upper body user support grip 221L to cooperate as one unit with upper body user support 220R and or upper body user support grip 221R. Therefore, latching together lower body user support 260L and lower body user support 260R would cause all user supports to cooperate as one unit and move in unison during the exercise regimen.

In certain embodiments such as those illustrated in FIGS. 9-15 and 23 the machine 200 can include two separate upper body user supports 220L and 220R and two separate upper body user support slide rails 215L and 215R. Upper body user support slide rails 215L and 215R can be configured such that a first upper end of slide rails 215L and 215R that are closer to the user U's head and torso are at a greater distance from one another, and a second end of upper body user support rails 215L and 215R that are distal to the user U's head and torso and are based on or about the exercise floor are at a lesser distance from one another, such that when upper body user supports 220L and 220R roll or slide on upper body user support rails 215L and 215R during the exercise regimen from the at rest to the activated position upper body user supports 220L and 220R are moving in a converging pattern of motion. In these embodiments when upper body user supports 220L and 220R roll or slide on upper body user support rails 215L and 215R during the exercise regimen from the activated position to the at rest position they are moving in a diverging pattern of motion. These embodiments also comprise a multi-directional pivoting link bar 225 also known as a "ball joint" link bar that is pivotably connected at a first end to upper body user support connection bracket 211 and pivotably connected at a second end to link bar 226, such that as upper body user supports 220L and 220R roll or slide along upper body user support rails 215L and 215R upper body user supports 220L and 220R can move in a converging and reciprocating diverging pattern while cooperating with lower body user support or supports 260 via rotatable multi-link linkage system 240.

In each embodiment resistance can be applied to the rotatable central axle 250 either directly or operatively thus imparting the desired amount of resistance to the user during the pressing motions of the exercise regimen. As illustrated in FIGS. 4, 8, 13, and 17-21 resistance weight arms 245 are rigidly connected to rotatable central axles 250 and removable resistance weights 246 are mounted onto resistance weight arms 245. As illustrated in the preferred embodiments of FIGS. 26-31, resistance weight arms 245 are rigidly connected to resistance weight arm axles 251, removable resistance weights 246 are mounted onto resistance weight arm 245, and resistance weight arms 245 are operatively connected to rotatable central axles 250. As illustrated in FIGS. 19-21 and 26-31, resistance weight arm stop 345 and resistance weight arm stop support 346 limit one direction of the travel of the rotatable multi-link linkage systems 240 thus limiting one direction of travel of the user supports and locate the at rest position of the functional components of machine 200. Although not illustrated, many forms of resistance can be operatively connected to the user supports or the rotatable multi-link linkage system or the rotatable central axle including but not limited to stack weights, hydraulic, pneumatic, springs, elastic bands, electromagnetic, adjustable moment arms, alternators, generators, and the like.

In certain embodiments lower body user support rails 213 may be configured in a curved shape as illustrated in FIGS. 1-17 and 22-23. In other embodiments lower body user support rails 213 may be configured in a linear shape as illustrated in FIGS. 18-21 and 26-31. In certain embodiments upper body user support rails 215 may be configured in a curved shape as illustrated in FIGS. 1-4, 9-17, and 23. In other embodiments upper body user support rails 215 may be configured in a double curve resembling somewhat of an "S" shape as illustrated in FIGS. 5-8. The machine 200 can comprise multiple combinations of user support rail shape configurations that can be operatively connect the upper and lower body user supports via one or more rotatable multi-link linkage system 240 that rotates around rotatable central axle 250.

As illustrated in the embodiments shown in FIGS. 1-23 the lower body user support or supports 260 comprises a first traveling member, which comprises wheel connection brackets 219 rigidly attached to the outer frame structure of lower body user support or supports 260. Support wheels 217 are rollably connected to connection brackets 219. Preferably, there are two or more sets of connection brackets 219 extending outward from lower body user support or supports 260 with two or more sets of support wheels 217 rollably connected to connection brackets 219. Support wheels 217 are rollably mounted onto slide rail 213 in a manner such that lower body user support 260 is effectively secured onto slide rail 213 in a slidable or rollable manner.

As illustrated in the preferred embodiments shown in FIGS. 26-31 the lower body user support or supports 260 is mounted on internal lower body user support transport assembly 310, which is rollably connected internally to slide rail 213. Internal lower body user support transport wheels 311 roll on the internal walls of slide rail 213 and are connected to user support 260 via internal lower body user support transport assembly brackets 312. Preferably, there are two or more sets of internal lower body user support transport assembly brackets 312 extending outward from lower body user support or supports 260 with two or more sets of Internal lower body user support transport wheels 311 rollably connected to internal lower body user support transport assembly brackets 312. Internal lower body user support transport wheels 311 are rollably mounted inside of slide rail 213 in a manner such that lower body user support 260 is effectively secured onto slide rail 213 in a slidable or rollable manner.

As illustrated in the embodiments shown in FIGS. 1-17 and 23 lower body user support or supports 260 comprises at least one pivoting link connection 223 attached to the lower portion of the lower body user support or supports 260. At least one pivoting link connection 223 rotatably or pivotably connects lower body user support or supports 260 to the second end of link bars 231. Link bars 231 and rotatable multi-link linkage system or systems 240 operatively connects or links the lower body user support or supports 260 to upper body user support or supports 220 in a manner such that the activation of the machine 200 by pressing and releasing on lower body user support or supports 260 and upper body user support or supports 220 causes the lower body user support or supports 260 and upper body user support or supports 220 to slide in the manner disclosed herein.

As illustrated in the embodiments shown in FIGS. 18-22 and 26-33 lower body user support or supports 260 comprises at least one pivoting link connection 223 attached to the lower portion of the lower body user support or supports 260. At least one pivoting link connection 223 rotatably or pivotably connects lower body user support or supports 260 to the second end of link bars 231. Link bars 231 and rotatable multi-link linkage system or systems 240 operatively connects or links the lower body user support or supports 260 to upper body user support grip or grips 221 in a manner such that the activation of the machine 200 by pressing and releasing on lower body user support or supports 260 and upper body user support grip or grips 221 causes the lower body user support or supports 260 to slide in the manner disclosed herein, and upper body user support grip or grips 221 to pivot in the manner disclosed herein.

As illustrated in the embodiments shown in FIGS. 1-17 and 23 the upper body user support 220 comprises connection brackets 211 rigidly attached to at least one upper body user support grip 221. Support wheels 222 are rollably mounted to connection brackets 211. Preferably, there are two or more sets of connection brackets 211 configured in a shape suitable as a traveling member to mount and roll on upper body user support rail 215 and support one or more upper body user support grips 221. As illustrated in the embodiments shown in FIGS. 1-17 and 23 upper body user support 220 comprises at least one pivoting link connection 223 attached to the central portion of the upper body user support or supports 220. Pivoting link connection 223 rotatably or pivotably connects upper body user support or supports 220 to a second end of link bars 224. Link bars 224 and rotatable multi-link linkage system or systems 240 operatively connects or links the upper body user support or supports 220 to lower body user support or supports 260 in a manner such that the activation of the machine 210 by pressing and releasing on lower body user support or supports 260 and upper body user support or supports 220 causes the lower body user support or supports 260 and upper body user support or supports 220 to slide or roll in the manner disclosed herein.

As illustrated in the embodiments shown in FIGS. 18-22 and 26-31 upper body user support grip 221 comprises on or more grip handles. Each grip handle is directly and rigidly connected to a second end of pivotable link bars 226, effectively becoming a part of link bar 226 such that upper body grip support handles 221 and link bars 226 can pivot and operate as a single component.

As illustrated in the embodiments shown in FIGS. 18-22 and 26-31 upper body user supports grip or grips 221 comprises at least one rigid connection to pivotable link bars 226. Link bars 226 and rotatable multi-link linkage system or systems 240 operatively connects or links the upper body user support grip or grips 221 to lower body user support or supports 260 in a manner such that the activation of the machine 200 by pressing and releasing on lower body user support or supports 260 and upper body user support grip or grips 221 causes the lower body user support or supports 260 to roll or slide in the manner disclosed herein and upper body user support grip or grips 221 to pivot in the manner disclosed herein.

As illustrated in the embodiments shown in FIGS. 1-17 and 23 the operative connection system between the lower body user support or supports 260 and the upper body user support or supports 220 is a rotatable multi-link linkage system or systems 240. Linkage system 240 consists of two upper elongated bar or rod like link members 224 and 226 and two lower elongated bar or rod like link members 229 and 231. Upper link bar 226 and lower link bar 229 are rigidly connected on opposing sides of rotatable central axle 250. Link bar 224 operatively connects linkage system 240 to upper body user support 220 and link bar 231 operatively connects linkage system 240 to lower body user support 260. Therefore, linkage system 240 and rotatable central axle 250 operatively connects or links the upper body user support or supports 220 to lower body user support or supports 260 in a manner such that the activation of the machine 200 by pressing and releasing on lower body user support or supports 260 and upper body user support or supports 220 causes the lower body user support or supports 260 and upper body user support or supports 220 to slide in the manner disclosed herein.

As illustrated in the embodiments shown in FIGS. 18-22 and 26-31 the operative connection system between the lower body user support or supports 260 and the upper body user support grip or grips 221 is a rotatable multi-link linkage system or systems 240. In these embodiments each linkage system 240 consists of one upper elongated bar or rod-like link member 226 and two lower elongated bar or rod-like link members 229 and 231. Upper link bar 226 and lower link bar 229 are rigidly connected on opposing sides of rotatable central axle 250. Link bar 226 operatively connects linkage system 240 to upper body user support grip 221 and link bar 231 operatively connects linkage system 240 to lower body user support 260. Therefore, linkage system 240 and rotatable central axle 250 operatively connects or links the upper body user support grip or grips 221 to lower body user support or supports 260 in a manner such that the activation of the machine 200 by pressing and releasing on lower body user support or supports 260 and upper body user support grip grips 221 causes the lower body user support or supports 260 to slide or roll in the manner disclosed herein and upper body user support grip or grips 221 to pivot in the manner disclosed herein.

As illustrated in the embodiments shown in FIGS. 32-33 the operative connection system between the lower body user support 260 and the upper body user support grip 221 is a rotatable multi-link linkage system or systems 240. In these embodiments linkage system 240 consists of one upper elongated bar or rod-like link member 226 and two lower elongated bar or rod-like link members 229 and 231. Upper link bar 226 and lower link bar 229 are rigidly connected on opposing sides of rotatable central axle 250. Link bar 226 operatively connects linkage system 240 to upper body user support grip 221 and link bar 231 operatively connects linkage system 240 to lower body user support 260. Therefore, linkage system 240 and rotatable central axle 250 operatively connects or links the upper body user support grip or grips 221 to lower body user support 260 in a manner such that the activation of the machine 200 by pressing and releasing on lower body user support 260 and upper body user support grip 221 causes the lower body user support or supports 260 to pivot in the manner disclosed herein and upper body user support grip or grips 221 to pivot in the manner disclosed herein.

As illustrated in the embodiments shown in FIGS. 4, 8, 13, 17-21, and 26-33 additional resistance can be applied to the exercise motion via the rotatable central axle 250 in a variety of manners. For example, an elongated rigid bar or rod-like member that can be curved or angled in shape such as resistance weight arm 245 is pivotable on a first end 251 and mounted on machine 200 proximal to rotatable central axle 250. Removable resistance weight 246 can be loaded on resistance weight arm 245 distal to the first rotatable end of resistance weight arm 245. Rotatable central axle 250 is operatively connected and cooperates with resistance weight arm 245 via rotatable torque arm lever 247 such that during the exercise motion resistance weight arm 245 will rotate and move removable resistance weight 246 in an upward arching motion. Another example would be an elongated rigid bar or rod-like member such as resistance weight arm 245 can be rigidly attached to the outermost portion of the rotatable central axle 250 and removable resistance weight 246 can be loaded onto resistance weight arm 245 distal to the rotatable central axle. Resistance weight arm 245 can be attached to the axle at a location that will cause the weight plates to move in an upward arcing motion during the pressing motion of the exercise regimen. Another example of adding resistance to the rotatable central axle 250 is to add a disk or cam (not illustrated) to the outer most portion of rotatable central axle 250. Said cam would have one end of a cable, belt, chain, lever, or other suitable resistance transference component (not illustrated) operatively connected to it and the opposing end connected to an external resistance force (not illustrated).

Each embodiment of the invention comprises at least one lower body user support 260 that is slidably attached to a sliding member, such as slide rail 213, or is pivotably attached to a pivot member such as lower body user support pivot assembly 400. The lower body user support 260 can be of multiple shapes and configurations to comfortably and effectively support the user U during the exercise regimen. The lower body user support 260 is a kneeling pad, such as lower body user support pad 218, sufficient in size to support an adult human's knees and shins. The lower body user support 260 can comprise a user support frame for holding the user support pad 218. The user support frame also can comprise or be attached to the foot platform 216. In all lower body user support embodiments, there may be adjustments to any of the components to fit the size of the user U.

As illustrated in the embodiments shown in FIGS. 1-17 and 23 the invention can comprise an upper body user support 220 that is slidably attached to, or cooperates with, a first location on a sliding member, such as slide rail 215. The upper body user support 220 can be of multiple shapes and configurations to comfortably and effectively support the user U during the exercise regimen. In most embodiments, the upper body user support 220 comprises a gripping handle such as grip handle 221. However, there may be multiple grips and can be various shapes, sizes, and lengths and connected to upper body user support 220 at various angles and locations. In all upper body user support embodiments, there may be adjustments to any of the components to fit the size of the user U.

As illustrated in the embodiments shown in FIGS. 18-22 and 26-31 the invention can comprise an upper body user support grip 221 that is rigidly attached to, or cooperates with, a first location on a pivoting link bar, such as link bar 226. The upper body user support grip or grips 221 can be of multiple shapes and configurations to comfortably and effectively support the user U during the exercise regimen. The upper body user support grip or grips 221 may rigidly connect to or rotatably connect to link bar 226 at various angles and locations. The location that upper body user support grips 221 connects to link bar 226 may also be adjustable to comfortably fit the user and provide the desired exercise motion.

As illustrated in the embodiments shown in FIGS. 1-17 and 23 the lower body user support 260 and upper body user support 220 are operatively connected, such that during operation of the machine 200 the operative connection mechanism controls the location of the lower body user support 260 on the sliding path defined by slide rail 213 and the location of upper body user support 220 on the sliding path defined by slide rail 215. In certain embodiments, this connection mechanism can be a multi-link rotatable linkage system 240 that attaches to the lower body user support 260 on the lower end of the linkage system and to an upper body user support 220 on the opposite and upper end of the linkage system.

As illustrated in the embodiments shown in FIGS. 18-22 and 26-31 the lower body user support 260 and upper body user support grip 221 are operatively connected, such that during operation of the machine 200 the operative connection mechanism controls the location of the lower body user support 260 on the sliding path defined by slide rail 213 and the location of upper body user support grip 221 on the pivoting path defined by link bar 226. In certain embodiments, this connection mechanism can be a multi-link rotatable linkage system 240 that attaches to the lower body user support 260 on the lower end of the linkage system and to upper body user support grip or grips 221 on the opposite and upper end of the linkage system.

As illustrated in FIGS. 32-33 the lower body user support 260 and upper body user support grip 221 are operatively connected, such that during operation of the machine 200 the operative connection mechanism controls the location of the lower body user support 260 on the arching path defined by lower body user support pivot assembly 400 and the location of upper body user support grip 221 on the pivoting path defined by link bar 226. In certain embodiments, this connection mechanism can be a multi-link rotatable linkage system 240 that attaches to the lower body user support 260 on the lower end of the linkage system and to upper body user support grip or grips 221 on the opposite and upper end of the linkage system.

In preferred embodiments, the user's hands engage an engagement means 221 and the user's feet engage an engagement means 216, which are both operatively connected to rotatable central axle 250 to move the lower body user support 260 and upper body user support grips 221 during the exercise motion.

As illustrated in the embodiments shown in FIGS. 1-17 and 23 the machine 200 has a mostly rectangular footprint with a kneeling lower body user support 260 movable on a sliding rail mounted on a proximal rearward portion of the machine 200, and an upper body user support 220 movable on a sliding rail mounted on a proximal forward portion of the machine 200. The lower body user support 260 and the upper body user support 220 are operatively linked via a rotating linkage system 240. The kneeling lower body user support 260 comprises a kneeling user support pad 218 for supporting the user's knees and shins.

As illustrated in the embodiments shown in FIGS. 18-22 and 26-31 the machine 200 has a mostly rectangular footprint with a kneeling lower body user support 260 movable on a sliding rail mounted on a proximal rearward portion of the machine 200, and an upper body user support grip or grips 221 movable on a pivoting bar 226 mounted on a proximal forward portion of the machine 200. The lower body user support 260 and the upper body user support grip or grips 221 are operatively linked via a rotating linkage system 240. The kneeling upper body user support 260 comprises a kneeling user support pad 218 for supporting the user's knees and shins.

As illustrated in the embodiments shown in FIGS. 32-33 the machine 200 has a mostly rectangular footprint with a kneeling lower body user support 260 movable on a four-bar link pivot assembly mounted on a proximal rearward portion of the machine 200, and an upper body user support grip or grips 221 movable on a pivoting bar 226 mounted on a proximal forward portion of the machine 200. The lower body user support 260 and the upper body user support grip or grips 221 are operatively linked via a rotating linkage system 240. The kneeling upper body user support 260 comprises a kneeling user support pad 218 for supporting the user's knees and shins.

In all preferred embodiments of the invention a foot pressing platform 216 is attached to the rearward most portion of the lower body user support 260 such that the foot pressing platform 216 is attached to the portion of the lower body user support 260 most distal to upper body user support grip or grips 221. The foot pressing platform 216 is an elongated platform or bar sufficient in size to support the user's feet during the exercise regimen. The foot pressing platform 216 is attached at its longest opposite ends to the lower body user support frame at a location a few inches rearward from the lower body user support pad 218 such that the user's feet can comfortably fit in the cavern created between the foot pressing platform 216 and the kneeling lower body user support pad 218. The foot pressing platform 216 is attached to the lower body user support 260 such that the user's legs are somewhat perpendicular to the foot pressing platform 216 when operating the machine 200.

As illustrated in FIGS. 1-23 and 26-31 the lower body user support 260 slidably cooperates with a slide rail 213 at a location proximal to the rearward half portion of machine 200. For example, the lower body user support 260 can have support wheels 217 attached to the outer portion of the lower body user support 260 via brackets 219, such that support wheels 217 engage with the slide rail 213 to allow the lower body user support 260 to slide or roll along the slide rail 213. Alternatively, bearings, low friction materials, or other sliding means can be substituted for wheels 217. The rearward portion of lower body user support 260 is attached proximal to a rearward location to the slide rail 213 that is in a lower elevation position than the forward and opposite end of the lower body user support 260, thus causing the lower body user support 260 to slope upwards from back to front in the at rest position. Slide rail 213 is mounted on the machine 200 with the rearward portion of slide rail 213 being proximal to the rearward end of machine 200. The slide rail 213 extends from the rearward portion of the machine 200 in a direction towards the upper body user support grips 221 at a distance suitable for sufficient operation of the machine 200 for its intended purpose. The linear slide rail 213 is attached to the machine 200 such that the rearward most part of the slide rail 213 is at a lower elevation than the forward portion of the slide rail 213 that terminates on or proximal to rotatable central axle 250.

As illustrated in the embodiments shown in FIGS. 1-17 and 23 the upper body user support 220 slidably cooperates with a slide rail 215 at a location proximal to a forward portion of machine 200. For example, the upper body user support 220 can have support wheels 222 attached to the outer portion of the upper body user support 220 via brackets 211, such that support wheels 222 engage with the slide rail 215 to allow the upper body user support to slide or roll along the slide rail 215. Alternatively, bearings, low friction materials, or other sliding means can be substituted for wheels 222. The rearward portion of upper body user support 220 is attached at a rearward location to the slide rail 215 that is in a higher elevation position than the forward and opposite end of the upper body user support 220, thus causing the upper body user support 220 to slope downwards from back to front. The slide rail 215 is mounted on the machine 200 with the forward portion of the slide rail 215 being proximal to the forward end of machine 200. The slide rail 215 extends from the forward portion of the machine 200 in a direction towards the lower body user support means 260 at a distance suitable for sufficient operation of the machine 200 for its intended purpose. The slide rail 215 is attached to the machine 200 at a sloping angle such that the forward most part of the slide rail 215 is at a lower elevation than the rearward portion of slide rail 215 that terminates closer to the center section of the machine 200.

As illustrated in the embodiments shown in FIGS. 18-22 and 26-33 the upper body user support grips 221 pivotably cooperates with rotatable central axle 250 via link bar 226 at a location proximal to a forward portion of machine 200. For example, the upper body user support grips 221 can be rigidly attached to link bar 226 distal to the end at which link bar 226 is rigidly attached to rotatable central axle 250 such that link bar 226 engages with the central axle 250 to allow the upper body user support grips 221 to pivot about axle 250. Upper body user support grips 221 and link bar 226 are mounted on machine 200 at a location that is a sufficient distance from lower body user support 260 suitable for sufficient operation of the machine 200 for its intended purpose.

As illustrated in the embodiments shown in FIGS. 1-17 and 23 one operative connection mechanism of this invention is a multi-link linkage system 240 having somewhat identical left and right sides. Each side is comprised of four links and a rotatable central axle. Each linkage system is configured as follows: a second end of link bar 224 pivotably connects to upper body user support 220 and a first end of link bar 224 is pivotably connected to a second end of the link bar 226. The first end of link bar 226 is rigidly connected to a rotatable central axle 250. The first end of link bar 229 is rigidly connected to the rotatable central axle 250 proximal to a location on the rotatable central axle opposite the location of the first end of link bar 226. A second end of link bar 229 is pivotably connected to a first end of link bar 231. A second end of link bar 231 is pivotably connected to the slidable lower body user support 260 at a pivotable connection 223. The rotatable central axle 250 is located between the slidable upper body user support 220 and the slidable lower body 260 so as to allow for optimal operation of the linkage system and not to impede the user during the exercise regimen.

In this embodiment the linkage system 240 preferably is configured such that in the at rest position the slidable upper body user support 220 and the slidable lower body user support 260 are located closer together, wherein the upper links 224, 226 form a "V" shape In the at rest position the lower links 229, 231 also form a "V" shape. In the at rest position the upper links 224, 226 are located proximally opposite of the lower links 229, 231 so that the lower links 229, 231 form somewhat of a "Z" shape with the rotatable central axle 250 being located proximal to the center of the "Z". In the fully activated position of the linkage mechanism 240 the slidable upper body user support 220 and slidable lower body user support 260 are farther apart, and the upper links 224, 226 create a wider more diverged "V" shape and may be more of a linear shape. Also in the fully activated position the lower links 229, 231 form a wider diverging "V" shape and may be of a more linear shape. In the fully activated position the upper links 224, 226 are located proximally opposite to the lower links 229, 231 so as to form an elongated "Z" or more linear shape with the rotatable central axle 250 being located proximal to the center of the elongated "Z" shape or more linear shape.

Prior to the operation of this embodiment, the user U can adjust the starting location of the lower body user support 260 relative to the upper body user support 220 to a comfortable exercise position. The user U then can load or select the desired amount of resistance.

During operation of this embodiment, the user U kneels on the lower body user support pad 218 and places their feet against the foot pressing platform 216, which is in the at rest position. The user U then grasps the hand grip 221 located on the upper body user support 220 which is in the at rest position. To begin the exercise, the user U pushes the upper body user support grip 221 with their hands and arms forward and away from the lower body user support 260 in a forward and downward motion while concurrently pressing the foot pressing platform 216 connected to the lower body user support 260 with their feet and legs rearward and downward and away from the upper body user support 220. This activates the rotatable multi-link linkage system 240 such that the links 224, 226, 229, and 231 rotate around rotatable central axle 250. This concurrent motion causes the lower body user support 260 to slide rearward and downward on slide rail 213 and away from the upper body user support 220. Concurrently, this causes the upper body user support 220 to slide forward and downward on slide rail 215 and away from the lower body user support 260. When the user decreases or releases the pressing force with their hands on upper body user support 220 and with their feet on lower body user support 260, the resistance means connected to rotatable central axle 250 will act upon linkage system 240 concurrently causing lower body user support 260 to slide towards the center of machine 200 to return to the at rest position and upper body user support 220 to slide towards the center of machine 200 to return to the at rest position.

In this embodiment the user U can press the lower body user support foot pressing platform 216 and the upper body user support grips 221 part way or all the way to the fully activated position so as to have activated a substantial amount of upper and lower body muscle groups. The user U can repeat the pressing and releasing action a number of times so as to complete a set of exercises. As can be seen, the present invention can exercise many of the upper and lower body muscle groups concurrently thus giving the user a more complete workout in a shorter period of time.

To operate this embodiment, the user enters the machine 200 and assumes a kneeling position on the slidable lower body user support 260 with their feet against the foot pressing plate 216. The user U grasps the pressing handle 221 located on the slidable upper body user support 220 while the machine 200 is in the at rest or unactivated position. In this at rest or unactivated position, the user's feet and hands are closer together with the user's arms and legs in a more contracted position. To activate the machine 200 the user simultaneously presses the foot pressing plate 216 with their feet while pressing the upper body user support handle 221 with their hands, causing the linkage system 240 to rotate such that the second end of link bar 224, which is pivotably connected to the slidable upper body user support 220, moves forward and downward, and the first end of link bar 224 is pivotably connected to second end of link bar 226 causing link 226 to rotate forward and away from the slidable lower body user support 260, thus causing the first end of link bar 226, which is rigidly connected to the rotatable central axle 250, to rotate on the rotatable central axle 250. This rotation of the rotatable central axle 250 causes the first end of link bar 229, which is rigidly connected to the rotatable central axle 250, to rotate, causing the second end of link bar 229, which is pivotably connected to the first end of link bar 231, to rotate rearward and away from the slidable upper body user support 220, thus causing the second end of link bar 231, which is pivotably connected to the slidable lower body user support 260, to move rearward and slide the lower body user support 260 away from the slidable upper body user support 220, thus sliding the lower body user support 260 and the upper body user support 220 in approximate opposite or diverging directions. The result is that the user U concurrently performs a leg pressing motion and an arm pressing motion in which the user's legs and arms extend.

In this embodiment the user may push the foot platform 216 and the grip handle(s) 221 part of the way or to the fully extended position. After the user U has pressed the foot plate 216 and the pressing handle 221 part of the way or to the fully extended position so as to have conducted the concurrent upper and lower body press motion, the user U can keep the pressing foot plate 216 and pressing grip handle 221 in the activated position for additional exertion of the legs, arms and torso. The user U then can release the pressing motion on the foot pressing plate 216 and the pressing grip handle 221 to allow the foot pressing plate 216 and pressing handle 221 to the move in the opposite converging direction where the slidable lower body user support 260 and the slidable upper body user support 220 move closer together. This movement causes the second end of link bar 231, which is pivotably attached to the lower body user support 260, to move in a forward direction, causing the first end of link bar 231 and the second end of link bar 229 to rotate forward and towards the upper body user support 220. This in turn causes the first end of link bar 229, which is rigidly connected to the rotatable central axle 250, to rotate on the rotatable central axle 250. This rotation of the rotatable central axle 250 causes the first end of link bar 226, which is rigidly connected to the rotatable central axle 250, to rotate on the rotatable central axle 250, causing the second end of link bar 26 and the first end of link bar 224 to move rearward and toward the lower body user support 260. This in turn causes the second end of link bar 224, which is pivotably connected to the upper body user support 220, to move upward, rearward, and closer to the lower body user support 260 and closer to the at rest or unactivated position.

Additionally in this embodiment, when the user U presses and releases the foot pressing plate 216 and concurrently presses and releases the pressing grip handles 221, the user U is contracting and releasing multiple sets of muscle groups of the arms, legs, and torso simultaneously. The user U can repeat the pressing and releasing motion a number of times so as to complete a set of exercises. As can be seen, this embodiment of the present invention can concurrently exercise many of the user's upper and lower body muscle groups, thus giving the user a more complete workout in a shorter amount of time.

As illustrated in the embodiments shown in FIGS. 16-17 and 23 in yet another embodiment, there are two separate and independent slidable upper body user supports 220, one for each of the user U's arms, and two separate and independent slidable lower body user supports 260, one for each of the user U's legs, and two separate and independent multi-link linkage systems 240, resulting in two separate and independent exercise apparatuses contained within this embodiment of the invention. Each left and right independent exercise apparatus consists of a slidable upper body user support 220 and a slidable lower body user support 260, which are each operatively connected by one multi-link linkage system 240 to independently exercise a combination of one of the user U's arms and one of the user U's legs concurrently. Each link 224, 226, 229, 231 is similar to an elongated rod or bar having opposite first and second ends. Each independent rotatable multi-link linkage system 240 is comprised of four links and a rotatable central axle.

Each linkage system 240 is configured as follows: a second end of link bar 224 pivotably connects to upper body user support 220 and a first end of link 224 is pivotably connected to a second end of the link bar 226. The first end of link bar 226 is rigidly connected to a rotatable central axle 250. The first end of link bar 229 is rigidly connected to the rotatable central axle 250 proximal to a location on the rotatable central axle 250 opposite the location of the first end of link 226. A second end of link bar 229 is pivotably connected to a first end of link bar 231. A second end of link bar 231 is pivotably connected to the slidable lower body user support 260 at a pivotable connection 223. The rotatable central axle 250 is located between the slidable upper body user support 220 and the slidable lower body support 260 so as to allow for optimal operation of the linkage system and not to impede the user during the exercise regimen.

Each independent rotatable multi-link linkage system 240 preferably is configured such that in the at rest position the slidable upper body user support 220 and the slidable lower body user support 260 are located closer together, wherein the first and second links 224, 226 form a "V" shape. In the at rest position the third and fourth links 229, 231 also form a "V" shape. In the at rest position the first and second links 224, 226 are located proximally opposite the third and fourth links 229, 231 so that the four links form somewhat of a "Z" shape with the rotatable central axle 250 being located proximal to the center of the "Z". In the fully activated position of the linkage mechanism 240 the slidable upper body user support 220 member and slidable lower body user support 260 are farther apart, and the first and second links 224, 226 create a wider more diverged "V" shape and may be more of a linear shape. Also in the fully activated position the third and fourth links 229, 231 form a wider diverging "V" shape and may be of a more linear shape. In the fully activated position the first and second links 224, 226 are located proximally opposite to the third and fourth links 229, 231 so as to form an elongated "Z" or more linear shape with the rotatable central axle 250 being located proximal to the center of the elongated "Z" shape or more linear shape.

In the independent left and right side user supports and linkages embodiment the user can choose to operate each side independently or engage the latch 325 as illustrated in FIG. 23 such that the lower body user supports 260 are latched together to operate the machine 200 as a single concurrent exercise. In the "independent or unlatched" mode the left and right linkage systems 240 can rotate freely on each rotatable central axle 250 independent of one another. In the "dependent or latched" mode the left and right side lower body user supports 260 are latched together thus causing through the rotatable central axles 250 and linkage systems 240 to rotate in unison. This latching and unlatching device 325 for the lower body user support 260 may consist of many known devices including pins, levers, gears, couplings, and the like. This latching and unlatching system also may be applied to any portion of the upper or lower body user supports or central axles or linkage system to achieve the same functions.

To operate the independent mode embodiment as illustrated in FIGS. 16-17 and 23 the user U enters the machine 200 and assumes a kneeling position on the two slidable lower body user supports 260 with one foot against the foot pressing plate 216 of each lower body user support 260. The user U grasps the two separate pressing handles 221 located on each of the two slidable upper body user supports 220 while the machine 200 is in the at rest or unactivated position. In this at rest or unactivated position the user U's feet and hands are closer together with the user U's arms and legs in a more contracted position. To activate the machine 200 the user U presses the left foot pressing plate 216 with their left foot while concurrently pressing the left upper body user support handle 221 with their left hand and or presses the right foot pressing plate 216 with their right foot while concurrently pressing the right upper body user support handle 221 with their right hand. Either or both of these actions will cause one or both of the independent linkage systems 240 to rotate such that the second end of link bar 224, which is pivotably connected to the slidable upper body user supports 220, moves forward and downward, and the first end of link bar 224 is pivotably connected to second end of link bar 226 causing link 226 to rotate forward and away from the slidable lower body user supports 260, thus causing the first end of link bar 226, which is rigidly connected to the rotatable central axle 250, to rotate on the rotatable central axle 250. This rotation of the rotatable central axle 250 causes the first end of link bar 229, which is rigidly connected to the rotatable central axle 250, to rotate, causing the second end of link bar 229, which is pivotably connected to the first end of link bar 231, to rotate rearward and away from the slidable upper body user supports 220, thus causing the second end of link bar 231, which is pivotably connected to the slidable lower body user supports 260, to move rearward and slide the lower body user supports 260 away from the slidable upper body user supports 220, thus sliding the lower body user supports 260 and the upper body user supports 220 member in approximate opposite or diverging directions. The result is that the user U concurrently performs a leg pressing motion and an arm pressing motion in which the user U's left leg and left arm extend and or performs a leg pressing motion and an arm pressing motion in which the user U's right leg and right arm extend.

In this embodiment the user U may push the foot platform(s) 216 and the grip handle(s) 221 part of the way or to the fully extended position(s). After the user U has pressed the foot plate(s) 216 and the pressing handle(s) 221 part of the way or to the fully extended position so as to have conducted the concurrent upper and lower body press motion(s), the user U can keep the pressing foot plate(s) 216 and pressing grip handle(s) 221 in the activated position for additional exertion of the legs, arms and torso. The user U then can release the pressing motion on the foot pressing plate(s) 216 and the pressing grip handle(s) 221 to allow the foot pressing plate(s) 216 and pressing handle(s) 221 to the move in the opposite converging direction where the slidable lower body user support(s) 260 and the slidable upper body user support(s) 220 move closer together. This movement causes either of the linkages systems 240 to rotate causing the second end of link bar(s) 231, which is pivotably attached to the lower body user support(s) 260, to move in a forward direction, causing the first end of link bar(s) 231 and the second end of link bar(s) 229 to rotate forward and towards the upper body user support(s) 220. This in turn causes the first end of link bar(s) 229, which is rigidly connected to the rotatable central axle(s) 250, to rotate on the rotatable central axle(s) 250. This rotation of the rotatable central axle(s) 250 causes the first end of link bar(s) 226, which is connected to the rotatable central axle(s) 250, to rotate on the rotatable central axle(s) 250, causing the second end of link bar(s) 226 and the first end of link bar(s) 224 to move rearward and toward the lower body user support(s) 260. This in turn causes the second end of link bar(s) 224, which is pivotably connected to the upper body user support(s) 220, to move upward, rearward, and closer to the lower body user support(s) 260 and closer to the at rest or unactivated position.

Additionally, in this embodiment when the user U presses and releases the foot pressing plate(s) 216 and concurrently presses and releases the pressing grip handle(s) 221, the user U is contracting and releasing multiple sets of muscle groups of the arms, legs, and torso simultaneously. The user U can repeat the pressing and releasing motion(s) a number of times so as to complete a set of exercises. As can be seen, this embodiment of the present invention can concurrently exercise many of the left side of the user's upper and lower body muscle groups or the right side of many of the user's upper and lower body muscle groups, or concurrently exercise both the right side and left side of the user's upper and lower body muscle groups, thus giving the user a more diverse and complete workout in a shorter amount of time.

As illustrated in the embodiments shown in FIGS. 18-22 and 26-31 a preferred operative connection mechanism of this invention is a multi-link linkage system 240 having somewhat identical left and right sides. Each side is comprised of three links and a rotatable central axle. Each linkage system is configured as follows: a second end of link bar 226 rigidly connects to upper body user support grips 221 and a first end of link bar 226 is rigidly connected to a rotatable central axle 250. A first end of link bar 229 is rigidly connected to the rotatable central axle 250 proximal to a location on the rotatable central axle opposite the location of the first end of link 226. A second end of link bar 229 is pivotably connected to a first end of link bar 231. A second end of link bar 231 is pivotably connected to the slidable lower body user support 260 at a pivotable connection 223. The rotatable central axle 250 is located between the pivotable upper body user support grip 221 and the slidable lower body user support 260 so as to allow for optimal operation of the linkage system and not to impede the user during the exercise regimen.

The linkage system 240 in this embodiment preferably is configured such that in the at rest position the pivotable upper body user support grip 221 and the slidable lower body user support 260 are located closer together, wherein the upper link bar 226 is an elongated member in a mostly vertical position in the at rest position and the lower links 229, 231 form a right angled "V" shape in the at rest position. In the fully activated position of the linkage mechanism 240 the pivotable upper body user support grips 221 and slidable lower body user support 260 are farther apart, and link bar 226 is in a more horizontal position and the lower link bars are in a wide "V" shape.

In this embodiment as illustrated in FIGS. 18-21 and 26-29 the left and right side linkage systems 240 are operatively connected via linkages connection bar 235, a unified lower body user support 260, and a unified upper body user support grip 221, thus joining linkages connection bar 235 a unified lower body user support 260 and a unified upper body user support grip 221 that are all operatively connected, which causes left and right side linkage systems 240 to operate in unison as a single linkage system. Conversely, in this embodiment as illustrated in FIGS. 22, 30, and 31 linkages connection bar 235 is omitted, there are two separate left and right side lower body user supports 260, and at least two separate left and right side upper body user support grips 221 such that left and right side linkage systems 240 can operate independently of one another, whereby left side lower body user support 260 and right side upper body user support grip 221 are operatively connected and move in unison but independently of right side lower body user support 260 and right side upper body user support grip 221, which are operatively connected together and move in unison.

As illustrated in FIG. 31 of this embodiment feet pressing platform latch 325 can be latched so as to secure left lower body user support 260 to right side lower body user support 260 thus causing left side linkage system 240 and right side linkage system 240 to operate in unison and move concurrently. Conversely, feet pressing platform latch 325 can be unlatched such that left and right side linkage systems 240 can operate independently of one another where left side lower body user support 260 and right side upper body user support grip 221 are operatively connected and move in unison but independently of right side lower body user support 260 and right side upper body user support grip 221 which are operatively connected together and move in unison.

Prior to the operation of this embodiment, the user U can adjust the starting location of the lower body user support or supports 260 relative to the upper body user support grip or grips 221 to a comfortable exercise position. The user U then can load or select the desired amount of resistance.

During operation of this embodiment, the user U kneels on the lower body user support pad or pads 218 and places their feet against the foot pressing platform or platforms 216, which is in the at rest position. The user U then grasps the hand grip or grips 221 which are in the at rest position. To begin the exercise, the user U pushes the upper body user support grip or grips 221 with their hands and arms forward and away from the lower body user support or supports 260 in a forward and downward pivoting motion while concurrently pressing the foot pressing platform or platforms 216 connected to the lower body user support or supports 260 with their feet and legs rearward and downward and away from the upper body user support grip or grips 221. This activates the rotatable multi-link linkage systems 240 such that the links 226, 229, 231 rotate around rotatable central axles 250. This concurrent motion causes the lower body user support or supports 260 to slide rearward and downward on slide rails 213 and away from the upper body user support grip or grips 221. Concurrently, this causes the upper body user support grip or grips 221 to pivot forward and downward about central axles 250 and away from the lower body user support or supports 260. When the user U decreases or releases the pressing force with their hands on upper body user support grip or grips 221 and with their feet on lower body user support or supports 260, the resistance means operatively connected to rotatable central axles 250 will act upon linkage systems 240 concurrently causing lower body user support or supports 260 to slide towards the center of machine 200 to return to the at rest position and upper body user support grip or grips 221 to pivot towards the center of machine 200 to return to the at rest position.

While operating this embodiment the user U can press the lower body user support foot pressing platform or platforms 216 and the upper body user support grip or grips 221 part way or all the way to the fully activated position so as to have activated a substantial amount of upper and lower body muscle groups. The user U can repeat the pressing and releasing action a number of times so as to complete a set of exercises. As can be seen, the present invention can exercise many of the upper and lower body muscle groups concurrently thus giving the user a more complete workout in a shorter period of time.

To operate this embodiment, the user enters the machine 200 and assumes a kneeling position on the slidable lower body user support or supports 260 with their feet against the foot pressing platform or platforms 216. The user U grasps the pressing grip or grips 221 located on the pivotable upper body user support while the machine 200 is in the at rest or unactivated position. In this at rest or unactivated position, the user U's feet and hands are closer together with the user U's arms and legs in a more contracted position. To activate the machine 200 the user U simultaneously presses the foot pressing platform or platforms 216 with their feet while pressing the upper body user support grip or grips 221 with their hands, causing the linkage systems 240 to rotate such that the second end of link bars 226 will move forward and away from the slidable lower body user support or supports 260, thus causing the first end of link bars 226, which are rigidly connected to the rotatable central axles 250, to rotate on the rotatable central axles 250. This rotation of the rotatable central axles 250 causes the first end of link bars 229, which is rigidly connected to the rotatable central axles 250, to rotate, causing the second end of link bars 229, which is pivotably connected to the first end of link bars 231, to rotate rearward and away from the pivotable upper body user support grip or grips 221, thus causing the second end of link bars 231, which is pivotably connected to the slidable lower body user support or supports 260, to move rearward and slide the lower body user supports 260 away from the pivotable upper body user support grip or grips 221, thus sliding the lower body user support or supports 260 and pivoting the upper body user support grip or grips 221 in approximate opposite or diverging directions. The result is that the user U concurrently performs a leg pressing motion and an arm pressing motion in which the user U's legs and arms extend.

While operating this embodiment, the user U may push the feet pressing platform or platforms 216 and the grip or grips 221 part of the way or to the fully extended position. After the user U has pressed the feet pressing platform or platforms 216 and the pressing grip or grips 221 part of the way or to the fully extended position so as to have conducted the concurrent upper and lower body press motion, the user U can keep the feet pressing platform or platforms 216 and pressing grip or grips 221 in the activated position for additional exertion of the legs, arms, and torso. The user U then can release the pressing motion on the feet pressing platform or platforms 216 and the pressing grip or grips 221 to allow the feet pressing platform or platforms 216 and pressing grip or grips 221 to the move in the opposite converging direction where the slidable lower body user support or supports 260 and the pivotable upper body user support grip or grips 221 move closer together. This movement causes the second end of link bars 231, which is pivotably attached to the lower body user support or supports 260, to move in a forward direction, causing the first end of link bars 231 and the second end link bars 229 to rotate forward and towards the upper body user support grip or grips 221. This in turn causes the first end of link bars 229, which is rigidly connected to the rotatable central axles 250, to rotate on the rotatable central axles 250. This rotation of the rotatable central axles 250 causes the first end of link bars 226, which is rigidly connected to the rotatable central axles 250, to rotate on the rotatable central axles 250, causing the second end of link bars 226 and upper body user support grip or grips 221 to move rearward and toward the lower body user support or supports 260 and closer to the at rest and unactivated position.

Additionally while operating this operating this embodiment, when the user U presses and releases the feet pressing platform or platforms 216 and concurrently presses and releases the pressing grip or grips 221, the user U is contracting and releasing multiple sets of muscle groups of the arms, legs, and torso simultaneously. The user U can repeat the pressing and releasing motion a number of times so as to complete a set of exercises. As can be seen, this embodiment of the present invention can concurrently exercise many of the user U's upper and lower body muscle groups, thus giving the user a more complete workout in a shorter amount of time.

As illustrated in the embodiment shown in FIGS. 22 and 30-31 in yet another embodiment, there are two separate and independent pivotable upper body user support grips 221, one for each of the user U's arms and two independent and separate slidable lower body user supports 260, one for each of the user U's legs, and two separate and independent multi-link linkage systems 240 resulting in two independent exercise apparatuses contained within this embodiment of the invention. Each somewhat identical left and right independent exercise apparatus consists of a pivotable upper body user support grips 221 and a slidable lower body user support 260, which are each operatively connected by one multi-link linkage system 240 to independently exercise a combination of one of the user U's arms and one of the user U's legs concurrently. Each link bar 226, 229, 231 is similar to an elongated rod or bar having opposite first and second ends. Each independent rotatable multi-link linkage system 240 is comprised of three links and a rotatable central axle. Each independent linkage system is configured as follows: a second end of link bar 226 is rigidly connected to a user support grip 221 and a first end of link bar 226 is rigidly connected to a rotatable central axle 250. A first end of link bar 229 is rigidly connected to the rotatable central axle 250 proximal to a location on the rotatable central axle opposite the location of the first end of link bar 226. A second end of link bar 229 is pivotably connected to a first end of link bar 231. A second end of link bar 231 is pivotably connected to the slidable lower body user support 260 at a pivotable connection 223. The rotatable central axle 250 is located between the pivotable upper body user support grip 221 and the slidable lower body support 260 so as to allow for optimal operation of the linkage system and not to impede the user during the exercise regimen.

Each independent rotatable multi-link linkage system 240 preferably is configured such that in the at rest position the pivotable upper body user support grip 221 and the slidable lower body user support 260 are located closer together, wherein the upper link bar 226 is an elongated member in a mostly vertical position in the at rest position and the lower links 229, 231 form a right angled "V" shape in the at rest position. In the fully activated position of the linkage mechanism 240 the pivotable upper body user support grips 221 and slidable lower body user support 260 are farther apart, and link bar 226 is in a more horizontal position and the lower link bars are in a wide "V" shape.

In the independent left and right side user supports and linkages embodiment Illustrated in FIGS. 22 and 30-31 the user can choose to operate each side independently or engage the latch 325 such that the lower body user supports 260 are latched together to operate the machine 200 as a single concurrent exercise. In the "independent or unlatched" mode the left and right linkage systems 240 can rotate freely on each rotatable central axle 250 independent of one another. In the "dependent or latched" mode the left and right side lower body user supports 260 are latched together thus causing the rotatable central axles 250 and linkage system 240 to rotate in unison. This latching and unlatching device 325 for the lower body user support 260 may consist of many known devices including pins, levers, gears, couplings, and the like. This latching and unlatching system also may be applied to any portion of the upper or lower body user supports 260 or central axles 250 or linkage system to achieve the same functions.

To operate the independent mode embodiment as illustrated in FIGS. 22 and 30-31 the user U enters the machine 200 and assumes a kneeling position on the two slidable lower body user supports 260 with one foot against the foot pressing plate 216 of each lower body user support 260. The user U grasps the two separate pressing handles 221 located on each of the two pivotable upper body user support grips 221 while the machine 200 is in the at rest or unactivated position. In this at rest or unactivated position the user U's feet and hands are closer together with the user U's arms and legs in a more contracted position. To activate the machine 200 the user U presses the left foot pressing plate 216 with their left foot while concurrently pressing the left upper body user support handle 221 with their left hand and or presses the right foot pressing plate 216 with their right foot while concurrently pressing the right upper body user support handle 221 with their right hand. Either or both of these actions will cause one or both of the independent linkage systems 240 to rotate such that such that the second end of link bar 226 will move forward and away from the slidable lower body user support 260, thus causing the first end of link bar 226, which is rigidly connected to the rotatable central axle 250, to rotate on the rotatable central axle 250. This rotation of the rotatable central axle 250 causes the first end of link bar 229, which is rigidly connected to the rotatable central axle 250, to rotate, causing the second end of link bar 229, which is pivotably connected to the first end of link bar 231, to rotate rearward and away from the pivotable upper body user support grip 221, thus causing the second end of link bar 231, which is pivotably connected to the slidable lower body user support 260, to move rearward and slide the lower body user support 260 away from the pivotable upper body user support grip 221, thus sliding the lower body user support 260 and pivoting the upper body user support grip 221 in approximate opposite or diverging directions. The result is that the user U concurrently performs a leg pressing motion and an arm pressing motion in which the user U's left leg and left arm extend and or performs a leg pressing motion and an arm pressing motion in which the user U's right leg and right arm extend.

The user U may push the foot platform(s) 216 and the grip handle(s) 221 part of the way or to the fully extended position(s). After the user U has pressed the foot plate(s) 216 and the pressing handle(s) 221 part of the way or to the fully extended position so as to have conducted the concurrent upper and lower body press motion(s), the user U can keep the pressing foot plate(s) 216 and pressing grip handle(s) 221 in the activated position for additional exertion of the legs, arms, and torso. The user U then can release the pressing motion on the foot pressing plate(s) 216 and the pressing grip handle(s) 221 to allow the foot pressing plate(s) 216 and pressing handle(s) 221 to move in the opposite converging direction where the slidable lower body user support(s) 260 and the pivotable upper body user support grip(s) 221 move closer together. This movement causes either of the linkages systems 240 to rotate causing the second end of link bar 231, which is pivotably attached to the lower body user support 260, to move in a forward direction, causing the first end of link bar 231 and the second end of link bar 229 to rotate forward and towards the upper body user support grip(s) 221. This in turn causes the first end of link bar 229, which is rigidly connected to the rotatable central axle 250, to rotate on the rotatable central axle 250. This rotation of the rotatable central axle 250 causes the first end of link bar 226, which is rigidly connected to the rotatable central axle 250, to rotate on the rotatable central axle 250, causing the second end of link bar 26 and upper body user support grip(s) 221 to move rearward and toward the lower body user support 260 and closer to the at rest and unactivated position.

Additionally when the user U presses and releases the foot pressing plate(s) 216 and concurrently presses and releases the pressing grip handle(s) 221, the user U is contracting and releasing multiple sets of muscle groups of the arms, legs and torso simultaneously. The user U can repeat the pressing and releasing motion(s) a number of times so as to complete a set of exercises. As can be seen, this embodiment of the present invention can concurrently exercise many of the left side of the user U's upper and lower body muscle groups or the right side of many of the user U's upper and lower body muscle groups, or concurrently exercise both the right side and left side of the user U's upper and lower body muscle groups, thus giving the user U a more diverse and complete workout in a shorter amount of time.

In the alternative embodiment illustrated in FIGS. 32-33 the lower body user support 260 is mounted on four-bar link pivot assembly 400 and operatively connected via multi-link linkage system 240 to upper body user support grip 221, whereby lower body user support 260 and upper body user support grips 221 cooperate with linkage system 240, which rotates around central axle 250 during operation of the machine.

In this embodiment the linkage system 240 preferably is configured such that in the at rest position as illustrated in FIG. 32 the pivoting upper body user support grip 221 and the pivoting lower body user support 260 are located closer together, wherein the upper links 226, are an elongated mostly vertical shape and the lower link bars 229 and 231 form a narrow right angled narrower "V" shape. In the fully activated position as illustrated in FIG. 33 the pivoting upper body user support grip 221 and the pivoting lower body user support 260 are located farther apart wherein upper links 226 are elongated and forward leaning at a proximal 45 degree angle and the lower link bars 229 and 231 form a somewhat right angled wider "V" shape.

Prior to the operation of this embodiment, the user U can adjust the starting location of the lower body user support 260 relative to the upper body user support grip 221 to a comfortable exercise position. The user U then can load or select the desired amount of resistance.

During operation of this embodiment, the user U kneels on the lower body user support pad 218 and places their feet against the foot pressing platform 216, which is in the at rest position. The user U then grasps the hand grip 221 located on the upper end of link bars 226 which is in the at rest position. To begin the exercise, the user U pushes the upper body user support grip 221 with their hands and arms forward and away from the lower body user support 260 in a forward and downward motion while concurrently pressing the foot pressing platform 216 connected to the lower body user support 260 with their feet and legs rearward and downward and away from the upper body user support grip 221. This activates the rotatable multi-link linkage system 240 such that the links 226, 229, 231 rotate about rotatable central axle 250. This concurrent motion causes the lower body user support 260 to pivot rearward and downward on lower body user support pivot assembly 400 and away from the upper body user support grip 221. Concurrently, this causes the upper body user support grip 221 to pivot forward and downward about central pivot axle 250 and away from the lower body user support 260. When the user U decreases or releases the pressing force with their hands on upper body user support grip 221 and with their feet on lower body user support 260, the resistance means connected to rotatable central axle 250 will act upon linkage system 240 concurrently causing lower body user support 260 to pivot towards the center of machine 200 to return to the at rest position and upper body user support grip 22 to pivot towards the center of machine 200 to return to the at rest position.

In this embodiment the user U can press the lower body user support foot pressing platform 216 and the upper body user support grips 221 part way or all the way to the fully activated position so as to have activated a substantial amount of upper and lower body muscle groups. The user U can repeat the pressing and releasing action a number of times so as to complete a set of exercises. As can be seen, the present invention can exercise many of the upper and lower body muscle groups concurrently thus giving the user a more complete workout in a shorter period of time.

To operate this embodiment, the user enters the machine 200 and assumes a kneeling position on the pivotable lower body user support 260 with their feet against the foot pressing plate 216. The user U grasps the pressing handle 221 located on link bar 226 while the machine 200 is in the at rest or unactivated position. In this at rest or unactivated position, the user U's feet and hands are closer together with the user U's arms and legs in a more contracted position. To activate the machine 200 the user U simultaneously presses the foot pressing plate 216 with their feet while pressing the upper body user support handle 221 with their hands, causing the linkage system 240 to rotate such that link bar moves forward and downward, and away from the pivoting lower body user support 260, thus causing the first end of link bar 226, which is rigidly connected to the rotatable central axle 250, to rotate on the rotatable central axle 250. This rotation of the rotatable central axle 250 causes the first end of link bar 229, which is rigidly connected to the rotatable central axle 250, to rotate, causing the second end of link bar 229, which is pivotably connected to the first end of link bar 231, to rotate rearward and away from the pivoting upper body user support grip 221, thus causing the second end of link bar 231, which is pivotably connected to the pivoting lower body user support 260, to move rearward and pivot the lower body user support 260 away from the pivoting upper body user support grip 221, thus pivoting the lower body user support 260 and the upper body user support 220 in approximate opposite or diverging directions. The result is that the user U concurrently performs a leg pressing motion and an arm pressing motion in which the user U's legs and arms extend.

In this embodiment the user U may push the foot platform 216 and the grip handle(s) 221 part of the way or to the fully extended position. After the user U has pressed the foot plate 216 and the pressing handle 221 part of the way or to the fully extended position so as to have conducted the concurrent upper and lower body press motion, the user U can keep the pressing foot plate 216 and pressing grip handle 221 in the activated position for additional exertion of the legs, arms and torso. The user U then can release the pressing motion on the foot pressing plate 216 and the pressing grip handle 221 to allow the foot pressing plate 216 and pressing handle 221 to move in the opposite converging direction where the slidable lower body user support 260 and the slidable upper body user support 220 move closer together. This movement causes the second end of link bar 231, which is pivotably attached to the lower body user support 260, to move in a forward direction, causing the first end of link bar 231 and the second end of link bar 229 to rotate forward and towards the upper body user support 220. This in turn causes the first end of link bar 229, which is rigidly connected to the rotatable central axle 250, to rotate on the rotatable central axle 250. This rotation of the rotatable central axle 250 causes the first end of link bar 226, which is rigidly connected to the rotatable central axle 250, to rotate on the rotatable central axle 250, causing the second end of link bar 26 and the first end of link bar 224 to move rearward and toward the lower body user support 260. This in turn causes the second end of link bar 224, which is pivotably connected to the upper body user support 220, to move upward, rearward, and closer to the lower body user support 260 and closer to the at rest or unactivated position.

In this embodiment the user U may push the foot platform 216 and the grip handle 221 part of the way or to the fully extended position. After the user U has pressed the foot plate 216 and the pressing handle 221 part of the way or to the fully extended position so as to have conducted the concurrent upper and lower body press motion, the user U can keep the pressing foot plate 216 and pressing grip handle 221 in the activated position for additional exertion of the legs, arms, and torso. The user U then can release the pressing motion on the foot pressing plate 216 and the pressing grip handle 221 to allow the foot pressing plate 216 and pressing handle 221 to the move in the opposite converging direction where the pivoting lower body user support 260 and the pivoting upper body user support 220 move closer together. This movement causes the second end of link bar 231, which is pivotably attached to the lower body user support 260, to move in a forward direction, causing the first end of link bar 231 and the second end of link bar 229 to rotate forward and towards the upper body user support 220. This in turn causes the first end of link bar 229, which is rigidly connected to the rotatable central axle 250, to rotate on the rotatable central axle 250. This rotation of the rotatable central axle 250 causes the first end of link bar 226, which is rigidly connected to the rotatable central axle 250, to rotate on the rotatable central axle 250, causing the second end of link bar 26 and user support grip 221 to move rearward and toward the lower body user support 260 and closer to the at rest or unactivated position.

Features and components of the preferred embodiment of the present invention include at least one lower body user support that is operatively connected to at least one upper body user support for exercising in multiple planes of motion, the machine comprising: (a) a stationary main frame having a front end and back end; (b) at least one stationary slide rail connected to or part of the machine 200 that supports at least one sliding or rolling lower body user support 260; (c) at least one pivoting upper body user support grip 221; (d) at least one lower body user support 260 engaging the slide rail or rails for movement in a fixed path along the slide rails by the user's legs and feet; and (e) at least one grip 221 for movement in a pivoting pattern by the user's hands. Engagement by the user's hands and or feet causes the upper body user support(s) and lower body user support(s) to move in opposing converging and diverging paths. Engagement of the user supports activates the operative linkage system or systems 240, which locate the user supports on their rolling or pivoting paths of motion during the exercise regimen.

Also in each embodiment, the lower body user support and the upper body user support can be movable between a first at rest position and a second fully activated position and can be maintained at any position between the first at rest position and the second fully activated position relative to one another as located by the operative linkage system 240.

Also in each embodiment, resistance can be added to the exercise motion to increase the exertion of the exercise. The resistance can be selected from but not limited to free weights, weight stacks, hydraulic devices, pneumatic devices, brake-clutch devices, elastic devices, friction devices, springs, and moment arm devices. The amount of weight resistance can be controlled by the user U. For example, if the resistance mechanism comprises a free weight bar, additional weights can be added to or removed from the weight bar in a conventional manner. Other resistance mechanisms can be used in their conventional manners.

Each of the components of the invention can be adjustable so as to provide a comfortable and appropriate exercise regimen.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

U User
200 Machine—Total Body Press
205 Front Support Frame
206 Base Frame
207 Upper Frame
208 Central Frame Support
210 Decorative Frame Shield
211 Upper Body User Support Connection Bracket
212 Slide Rail Support
213 Lower Body Slide Rail
215 Lower Body Slide Rail
216 Feet Pressing Plate
217 Lower Body User Support Wheels
218 Lower Body User Support Pad
219 Lower Body User Support Connection Brackets
220 Upper Body User Support
221 Upper Body User Support Grip Handle
222 Upper Body User Support Wheels
223 Link Bar Pivot
224 Link Bar
225 Multi-Directionally pivoting link bar
226 Link Bar
229 Link Bar
231 Link Bar
235 Linkages Connection Bar
240 Rotatable Multi-Link Linkage System
245 Resistance Weight Arm
246 Removable Resistance Weight
247 Rotatable Torque Arm Lever
248 Rotatable Torque Arm Lever Wheel
249 Rotatable Torque Arm Lever Mounting Bracket
250 Rotatable Central Axle
251 Resistance Weight Arm Axle
255 Upper Body User Support Connection Brackets
260 Lower Body User Support
272 User Mounting Step
310 Internal Lower Body User Support Transport Assembly
311 Internal Lower Body User Support Transport Wheels
312 Internal Lower Body User Support Transport Assembly Bracket
315 Rear Frame Connector
320 Front Frame Connector
325 Feet Pressing Platform Latch
345 Resistance Weight Arm Stop
346 Resistance Weight Arm Stop Support
400 Lower Body User Support Pivot Assembly
410 Lower Body User Support Pivot Bar
415 Lower Body User Support Pivot Bar Axle

What is claimed is:

1. A concurrent upper body press and lower body press exercise machine comprising:

a) a structural frame having a front end and a back end, the frame comprising at least one lower body user support member and at least one upper body user support member, the at least one lower body user support member comprising a kneeling pad and the at least one upper body user support member comprising a gripping handle;

b) a first traveling member for traveling in a fixed path along the frame for transporting the at least one lower body user support member along the frame in a back and forth manner towards and away from the back end of the frame;

c) a second traveling member for traveling in a fixed path along the frame for transporting the at least one upper body user support member along the frame in a back and forth manner towards and away from the front end of the frame;

d) a foot platform connected to the at least one lower body user support member for engagement by a user's feet while exercising;

e) the gripping handle comprises a grip handle connected to the at least one upper body user support member for engagement by the user's hands while exercising;

f) a movable multi-link linkage system operatively connected to at least one rotatable central axle that operatively connects the at least one lower body user support member and the at least one upper body user support member, wherein the at least one upper body user support member is operatively connected to the at least one rotatable central axle and the at least one lower body user support member is operatively connected to the at least one rotatable central axle, wherein the multi-link linkage system comprises links, and wherein at least one of the links is pivotably connected to the lower body user support member and at least another one of the links is pivotably connected to the upper body user support member; and g) wherein resistance generated by weight of the user concurrently imparts force against at least one direction of the movement of the at least one upper body user support member and the at least one lower body user support, wherein the at least one upper body user support member and the at least one lower body user support member are more proximal to each other when the machine is in an at rest position or not engaged or active than when in a fully active position or engaged and activated, and wherein the at least one upper body user support member and the at least one lower body user support member are more distal to each other any time the machine is in the fully active position or engaged and activated than when in the at rest position or not engaged or active.

2. The exercise machine of claim 1, wherein the rotatable central axle is located between the at least one upper body user support member and the at least one lower body user support member.

3. The exercise machine of claim 2, wherein the rotatable central axle is connected to or generates a resistance force and transfers the resistance force concurrently to the at least one upper body user support member and the at least one lower body user support member via the multi-link linkage operative connection mechanism during operation of the machine.

4. The exercise machine of claim 3, wherein movement of the at least one upper body user support member in a direction towards the front of the machine concurrently causes movement of the at least one lower body user support member in a direction towards the back of the machine, and movement of the at least one lower body user support member in the direction towards the front of the machine concurrently causes the at least one upper body user support member to move in the direction towards the back of the machine, and the location of the least one upper body user support member between the at rest position and the fully activated position locates the at least one lower body user support member between the at rest position and the fully activated position.

5. The exercise machine of claim 4, wherein the at least one lower body user support member comprises two separate lower body user support members and the at least one upper body user support member comprises two separate upper body user support members.

6. The exercise machine of claim 5, wherein:

the two separate upper body user support members are a left side upper body user support member and a right side upper body user support member, and the two separate lower body user support members are a left side lower body user support member and a right side lower body user support member; and the left side upper body user support member is operatively connected to the left side lower body user support member such that the left side upper body user support member and the left side lower body user support member move in unison, and the right side upper body user support member is operatively connected to the right side lower body user support member such that the right side upper body user support member and right side lower body user support member move in unison, and the left side upper and lower body user support members operate independently of the right side upper and lower body user support members.

7. The exercise machine of claim 6, wherein the two separate lower body user support members are latchable together to move in unison causing the two separate upper body user support members and the two separate lower body user support members and the operative linkage system and the resistance system to all operate concurrently and in unison.

8. The exercise machine of claim 5, wherein the two separate upper body user support members moves in a forward converging motion from the at rest position and a rearward diverging motion from the fully activated position, and the two separate lower body user support members moves in a parallel motion.

9. The exercise machine of claim 5, wherein the two separate upper body user support members move in a forward converging motion from the at rest position and a rearward diverging motion from the fully activated position, and the two separate lower body user support members move in a rearward diverging motion from the at rest position and a forward converging motion from the fully activated position.

10. The exercise machine of claim 5, wherein the two separate upper body user support members slides forward towards the front of the machine and rearward towards the back of the machine in a curved pattern and the two separate lower body user support members slides forward towards the front of the machine and rearward towards the back of the machine in a curved pattern.

11. The exercise machine of claim 1, wherein the resistance is variable throughout a range of motion of the user support members.

12. The exercise machine of claim 1, wherein the resistance is constant throughout a range of motion of the user supports.

13. The exercise machine of claim 1, wherein at least a portion of the movable multi-link linkage system operatively connected to the at least one rotatable central axle is located between the at least one upper body user support member and the at least one lower body user support member.

14. The exercise machine of claim 1, wherein the at least one lower body user support member is a sliding member and the at least one upper body user support member is a sliding member.

15. The exercise machine of claim 1, wherein the at least one lower body user support member slides forward towards the front of the machine and rearward towards the back of the machine on a curved rail.

16. The exercise machine of claim 1, wherein the at least one upper body user support member slides forward towards the front of the machine and rearward towards the back of the machine on a curved rail.

* * * * *